US009481942B2

(12) United States Patent
Zhou et al.

(10) Patent No.: US 9,481,942 B2
(45) Date of Patent: Nov. 1, 2016

(54) GEOMETRY AND PROCESS OPTIMIZATION FOR ULTRA-HIGH RPM PLATING

(71) Applicant: Lam Research Corporation, Fremont, CA (US)

(72) Inventors: Jian Zhou, West Linn, OR (US); Cian Sweeney, Portland, OR (US); Zhian He, Lake Oswego, OR (US); Jonathan David Reid, Sherwood, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 14/613,306

(22) Filed: Feb. 3, 2015

(65) Prior Publication Data

US 2016/0222535 A1 Aug. 4, 2016

(51) Int. Cl.

| | |
|---|---|
| ***C25D 17/00*** | (2006.01) |
| ***C25D 7/12*** | (2006.01) |
| ***C25D 5/08*** | (2006.01) |
| ***C25D 5/04*** | (2006.01) |

(52) U.S. Cl.

CPC . *C25D 5/08* (2013.01); *C25D 5/04* (2013.01); *C25D 7/12* (2013.01); *C25D 17/001* (2013.01)

(58) Field of Classification Search

None

See application file for complete search history.

(56) References Cited

U.S. PATENT DOCUMENTS

| | | | |
|---|---|---|---|
| 1,255,395 | A | 2/1918 | Duram |
| 3,360,248 | A | 12/1967 | Lindeman et al. |
| 3,849,002 | A | 11/1974 | Hach |
| 4,101,919 | A | 7/1978 | Ammann |
| 4,229,191 | A | 10/1980 | Moore |
| 4,297,217 | A | 10/1981 | Hines et al. |
| 4,816,081 | A | 3/1989 | Mehta et al. |
| 5,000,827 | A | 3/1991 | Schuster et al. |
| 5,221,449 | A | 6/1993 | Colgan et al. |
| 5,281,485 | A | 1/1994 | Colgan et al. |
| 5,482,611 | A | 1/1996 | Helmer et al. |
| 5,555,234 | A | 9/1996 | Sugimoto |
| 5,800,626 | A | 9/1998 | Cohen et al. |

(Continued)

FOREIGN PATENT DOCUMENTS

| | | |
|---|---|---|
| EP | 0 860 866 | 8/1998 |
| JP | 2006-004955 | 1/2006 |

(Continued)

OTHER PUBLICATIONS

U.S. Appl. No. 14/085,262, filed Nov. 20, 2013, entitled "Alkaline Pretreatment for Electroplating".

(Continued)

*Primary Examiner* — Harry D Wilkins, III

(74) *Attorney, Agent, or Firm* — Weaver Austin Villenueve & Sampson LLP

(57) ABSTRACT

Various embodiments herein relate to methods and apparatus for electroplating metal onto substrates. The apparatus used to practice electroplating may be designed to have a geometric configuration that makes it difficult for air to travel and become trapped under the substrate. By using such apparatus, electroplating can occur at higher rates of substrate rotation than would otherwise be acceptable. The higher rate of substrate rotation allows electroplating to occur at higher limiting currents, which in turn increases throughput. The disclosed embodiments are particularly useful in the context of electrolytes that otherwise exhibit a relatively low limiting current (e.g., electrolytes having a low concentration of metal ions), though the embodiments are not so limited.

26 Claims, 20 Drawing Sheets

(56) References Cited

U.S. PATENT DOCUMENTS

| | | | | |
|---|---|---|---|---|
| 5,831,727 | A | 11/1998 | Stream | |
| 5,982,762 | A | 11/1999 | Anzai et al. | |
| 5,985,762 | A | 11/1999 | Geffken et al. | |
| 6,004,470 | A | 12/1999 | Abril | |
| 6,017,437 | A | 1/2000 | Ting et al. | |
| 6,074,544 | A | 6/2000 | Reid et al. | |
| 6,099,702 | A | 8/2000 | Reid et al. | |
| 6,110,346 | A | 8/2000 | Reid et al. | |
| 6,124,203 | A | 9/2000 | Joo et al. | |
| 6,126,798 | A | 10/2000 | Reid et al. | |
| 6,139,712 | A | 10/2000 | Patton et al. | |
| 6,156,167 | A | 12/2000 | Patton et al. | |
| 6,159,354 | A | 12/2000 | Contolini et al. | |
| 6,162,344 | A | 12/2000 | Reid et al. | |
| 6,179,973 | B1 | 1/2001 | Lai et al. | |
| 6,179,983 | B1 | 1/2001 | Reid et al. | |
| 6,193,854 | B1 | 2/2001 | Lai et al. | |
| 6,193,859 | B1 | 2/2001 | Contolini et al. | |
| 6,217,716 | B1 | 4/2001 | Fai Lai | |
| 6,221,757 | B1 | 4/2001 | Schmidbauer et al. | |
| 6,251,242 | B1 | 6/2001 | Fu et al. | |
| 6,261,433 | B1 | 7/2001 | Landau | |
| 6,274,008 | B1 | 8/2001 | Gopalraja et al. | |
| 6,277,249 | B1 | 8/2001 | Gopalraja et al. | |
| 6,333,275 | B1 | 12/2001 | Feng et al. | |
| 6,413,388 | B1 | 7/2002 | Uzoh et al. | |
| 6,503,376 | B2 | 1/2003 | Toyoda et al. | |
| 6,540,899 | B2 | 4/2003 | Keigler | |
| 6,544,585 | B1 | 4/2003 | Kuriyama et al. | |
| 6,551,487 | B1 | 4/2003 | Reid et al. | |
| 6,582,578 | B1 | 6/2003 | Dordi et al. | |
| 6,689,257 | B2 | 2/2004 | Mishima et al. | |
| 6,800,187 | B1 | 10/2004 | Reid et al. | |
| 6,964,792 | B1 | 11/2005 | Mayer et al. | |
| 7,014,679 | B2 | 3/2006 | Parekh et al. | |
| 7,097,410 | B1 | 8/2006 | Reid et al. | |
| 7,670,950 | B2 | 3/2010 | Richardson et al. | |
| 7,686,927 | B1 | 3/2010 | Reid et al. | |
| 7,771,662 | B2 | 8/2010 | Pressman et al. | |
| 8,404,095 | B2 | 3/2013 | Perkins et al. | |
| 8,795,480 | B2 * | 8/2014 | Mayer | C25D 5/08 204/212 |
| 8,962,085 | B2 | 2/2015 | Mayer et al. | |
| 2001/0035346 | A1 | 11/2001 | Maeda | |
| 2002/0027080 | A1 | 3/2002 | Yoshioka et al. | |
| 2002/0029973 | A1 | 3/2002 | Maydan | |
| 2002/0084183 | A1 | 7/2002 | Hanson et al. | |
| 2002/0084189 | A1 | 7/2002 | Wang et al. | |
| 2002/0195352 | A1 | 12/2002 | Mayer et al. | |
| 2004/0084315 | A1 | 5/2004 | Mizohata et al. | |
| 2004/0188257 | A1 | 9/2004 | Klocke et al. | |
| 2004/0198190 | A1 | 10/2004 | Basol et al. | |
| 2004/0200725 | A1 | 10/2004 | Yahalom et al. | |
| 2004/0262165 | A1 | 12/2004 | Kanda et al. | |
| 2005/0026455 | A1 | 2/2005 | Hamada et al. | |
| 2005/0255414 | A1 | 11/2005 | Inabe et al. | |
| 2006/0102485 | A1 | 5/2006 | Nakano et al. | |
| 2006/0141157 | A1 | 6/2006 | Sekimoto et al. | |
| 2006/0266393 | A1 | 11/2006 | Verhaverbeke et al. | |
| 2008/0149487 | A1 | 6/2008 | Lee | |
| 2008/0200018 | A1 | 8/2008 | Kawamoto | |
| 2010/0032310 | A1 * | 2/2010 | Reid | C25D 21/12 205/261 |
| 2010/0044236 | A1 * | 2/2010 | Mayer | C23C 18/1601 205/80 |
| 2010/0084275 | A1 | 4/2010 | Hanafusa | |
| 2010/0116672 | A1 * | 5/2010 | Mayer | C23C 18/1601 205/97 |
| 2010/0200960 | A1 | 8/2010 | Angyal et al. | |
| 2010/0320081 | A1 | 12/2010 | Mayer et al. | |
| 2010/0320609 | A1 | 12/2010 | Mayer et al. | |
| 2011/0043239 | A1 | 2/2011 | Tomita et al. | |
| 2011/0284386 | A1 | 11/2011 | Willey et al. | |
| 2013/0171833 | A1 | 7/2013 | Buckalew et al. | |
| 2014/0097088 | A1 | 4/2014 | Stowell et al. | |
| 2014/0230860 | A1 | 8/2014 | Chua et al. | |

FOREIGN PATENT DOCUMENTS

| | | |
|---|---|---|
| JP | 2007-138304 | 6/2007 |
| JP | 2009-064599 | 3/2009 |
| KR | 10-1999-0029433 | 4/1999 |
| KR | 10-2001-0052062 | 6/2001 |
| KR | 10-2004-0020882 | 3/2004 |
| TW | I281516 | 5/2007 |
| WO | WO 99/10566 | 3/1999 |
| WO | WO 99/41434 | 8/1999 |
| WO | WO 01/68952 | 9/2001 |
| WO | WO 02/062446 | 8/2002 |
| WO | WO 02/062466 | 8/2002 |
| WO | WO 2007/112768 | 10/2007 |
| WO | WO 2010/148147 | 12/2012 |

OTHER PUBLICATIONS

U.S. Appl. No. 09/872,340, filed May 31, 2001, entitled "Methods and Apparatus for Bubble Removal in Wafer Wet Processing".

U.S. Appl. No. 14/326,899, filed Jul. 9, 2014, entitled "Apparatus for Wetting Pretreatment for Enhanced Damascene Metal Filling".

U.S. Appl. No. 12/961,274, filed Dec. 6, 2010 entitled "Deionized Water Conditioning System and Methods".

U.S. Appl. No. 13/460,423, filed Apr. 30, 2012, titled "Wetting Wave Front Control for Reduced Air Entrapment During Wafer Entry Into Electroplating Bath."

US Office Action, dated Aug. 31, 2005, issued in U.S. Appl. No. 09/872,340 .

US Office Action, dated Apr. 14, 2005, issued in U.S. Appl. No. 09/872,340.

US Office Action, dated Jan. 18, 2006, issued in U.S. Appl. No. 09/872,340.

US Office Action, dated May 26, 2006, issued in U.S. Appl. No. 09/872,340.

US Office Action, dated Nov. 8, 2006, issued in U.S. Appl. No. 09/872,340.

US Final Office Action, dated Mar. 14, 2007, issued in U.S. Appl. No. 09/872,340.

US Office Action, dated Jun. 27, 2012 in U.S. Appl. No. 12/684,787.

US Office Action, dated Apr. 8, 2013 in U.S. Appl. No. 12/684,787.

US Final Office Action, dated Jul. 24, 2013 in U.S. Appl. No. 12/684,787.

US Office Action, dated Oct. 29, 2013 in U.S. Appl. No. 12/684,787.

US Final Office Action, dated Mar. 3, 2014 in U.S. Appl. No. 12/684,787.

US Office Action, dated Aug. 26, 2014 in U.S. Appl. No. 12/684,787.

US Notice of Allowance, dated Oct. 10, 2014 in U.S. Appl. No. 12/684,787.

US Notice of Allowance (Supplemental Notice of Allowability), dated Oct. 22, 2014 in U.S. Appl. No. 12/684,787.

US Notice of Allowance (Supplemental Notice of Allowability), dated Oct. 28, 2014 in U.S. Appl. No. 12/684,787.

US Office Action, dated Apr. 12, 2011, issued in U.S. Appl. No. 12/684,792.

US Final Office Action, dated Jul. 26, 2011, issued in U.S. Appl. No. 12/684,792.

US Office Action, dated Sep. 27, 2013, issued in U.S. Appl. No. 12/684,792.

US Final Office Action, dated Apr. 10, 2014, issued in U.S. Appl. No. 12/684,792.

US Office Action, dated Jun. 6, 2013, issued in U.S. Appl. No. 12/961,274.

US Final Office Action, dated Oct. 28, 2013, issued in U.S. Appl. No. 12/961,274.

US Notice of Allowance, dated Jan. 21, 2014, issued in U.S. Appl. No. 12/961,274.

(56) References Cited

OTHER PUBLICATIONS

US Office Action, dated Jul. 25, 2014, issued in U.S. Appl. No. 12/961,274.
US Final Office Action, dated Nov. 28, 2014, issued in U.S. Appl. No. 12/961,274.
PCT International Search Report and Witten Opinion, dated Jan. 5, 2011, issued in PCT/US2010/038901.
PCT International Preliminary Report on Patentability and Written Opinion dated Jan. 5, 2012, issued in PCT/US2010/038901.
Chinese First Office Action dated Aug. 14, 2014 issued in CN Application No. 201080026847.7.
Korean Office Action, dated Jan. 5, 2012 in KR Application No. 2010-7026340.
Taiwan Office Action dated Nov. 18, 2014 issued in TW Application No. 099119625.

* cited by examiner

| | Baseline DC Clamp Ring Hardware | | | | Modified DC Clamp Ring Hardware | | | |
|---|---|---|---|---|---|---|---|---|
| | NU at 5 mm EE | NU at 4 mm EE | NU at 3 mm EE | Wafer Surface | NU at 5 mm EE | NU at 4 mm EE | NU at 3 mm EE | Wafer Surface |
| Condition 1: 15 A, 120 RPM, 6 LPM, 2 mm PG | 0.90% | 1.20% | 1.80% |  | 0.80% | 1.20% | 2.00% |  |
| Condition 2: 25 A, 300 RPM, 15 LPM, 1 mm PG | 5.30% | 2.20% | 8.80% |  | 1.00% | 1.00% | 2.10% |  |
| Condition 3: 25 A, 300 RPM, 15 LPM, 2 mm PG | -- | -- | -- |  | 1.70% | 2.30% | 2.30% |  |
| Condition 4: 25 A, 300 RPM, 12 LPM, 2 mm PG | -- | -- | -- |  | 3.20% | 3.60% | 3.80% |  |

| | Baseline DC Clamp Ring Hardware | Modified DC Clamp Ring Hardware |
|---|---|---|
| Condition 1: 15 A, 120 RPM, 6 LPM, 2 mm PG | 143.3% | 140.9% |
| Condition 2: 25 A, 300 RPM, 15 LPM, 1 mm PG | Not collected | 144.0% |
| Condition 3: 25 A, 300 RPM, 15 LPM, 2 mm PG | -- | 143.2% |
| Condition 4: 25 A, 300 RPM, 12 LPM, 2 mm PG | -- | 143.8% |

FIG. 12B

| | Baseline DC Clamp Ring Hardware | Modified DC Clamp Ring Hardware |
|---|---|---|
| Recipe 1: Sensitive to pits |  |  |
| Recipe 2: Sensitive to fine particles/ protrusions |  |  |

GEOMETRY AND PROCESS OPTIMIZATION FOR ULTRA-HIGH RPM PLATING

BACKGROUND

As the semiconductor industry continues to advance, new processing challenges continue to arise. For example, the use of a thinner seed layer can be beneficial in various electroplating contexts, but the thinner seed layer heightens the risk that the seed layer will dissolve before plating occurs. In order to combat this issue, deposition often occurs at a relatively high over-potential using electroplating solutions having low metal ion concentrations. Unfortunately, the limiting current in such electroplating applications is relatively low, which leads to a low throughput. While certain techniques may be used to increase throughput, these techniques may introduce various additional processing challenges.

SUMMARY

Certain embodiments herein relate to methods and apparatus for electroplating material onto substrates. The apparatus used may be one having a peripheral passage that has particular dimensions optimized to minimize the likelihood that bubbles become trapped under the substrate during plating. This allows plating to occur at higher substrate rotation rates than would otherwise be possible. In one aspect of the embodiments herein, an apparatus for electroplating metal onto a substrate, the apparatus including: a substrate support for supporting the substrate at its periphery, where when the substrate is present in the substrate support, a plating face of the substrate is held in a substrate plating plane; a plating gap formed below the substrate plating plane and above an opposing surface positioned under the substrate plating plane; a pump for delivering electrolyte such that the electrolyte flows into the plating gap; a peripheral passage positioned radially outside of the substrate support, where the peripheral passage has a dimensionless peripheral passage parameter of about 2 or greater, and where electrolyte flows through the peripheral passage after the electrolyte exits the plating gap at the periphery of the plating gap and before the electrolyte reaches an electrolyte-air interface; and a controller having instructions to control electroplating in a manner that does not result in the passage of air through the peripheral passage and under the substrate.

In some embodiments, the peripheral passage is at least partially defined by the substrate support. In these or other embodiments, the peripheral passage may be at least partially defined by a ring positioned radially outside of the substrate support. The ring may be a dual cathode clamp ring or a shielding ring in some cases. The ring may be made of an electrically insulating material.

The peripheral passage may have a dimensionless peripheral passage parameter between about 2-10 in some embodiments, for example between about 2-3.5. The peripheral passage may have a height of at least about 0.1 inches, for example between about 0.1-1 inches in some cases. The electrolyte-air interface has a resting position when the substrate is not being rotated. In some embodiments, a vertical distance between the substrate plating plane and the resting position of the electrolyte-air interface is at least about 10 mm. The peripheral passage is annularly shaped in some embodiments. In other embodiments, the peripheral passage is not annularly shaped. In one example, the apparatus may further include an inlet above a channeled ionically resistive plate (CIRP) for providing electrolyte to the plating gap and an outlet above the CIRP for receiving electrolyte from the plating gap, the inlet and outlet each extending between about 90-180° around the plating gap, the inlet and outlet positioned on opposite sides of the plating gap, where the peripheral passage is positioned proximate the outlet. In certain cases the plating gap may have a height between about 0.5-6 mm, or between about 1-2 mm.

In certain embodiments, the electrolyte follows a flow path after exiting the plating gap and before reaching the electrolyte-air interface, the flow path having a tortuosity of at least about 1.1. The peripheral passage may be at least partially defined between a first surface that is substantially stationary during electroplating and a second surface that rotates during electroplating. In various cases, the apparatus further includes a substrate rotation mechanism for rotating the substrate within the substrate plating plane, where the controller has instructions to rotate the substrate within the substrate plating plane via the substrate rotation mechanism.

As noted above, the opposing surface positioned under the substrate plating plane may be a surface of a channeled ionically resistive plate (CIRP), the CIRP including a number of through-holes, where the pump delivers electrolyte such that the electrolyte passes from below the CIRP, through the through-holes in the CIRP, and into the plating gap. In some cases at least a portion of the through-holes are oriented at a non-normal angle with respect to the substrate plating plane.

In another aspect of the disclosed embodiments, a method of electroplating metal onto a substrate is provided, the method including: positioning the substrate in a substrate support; immersing the substrate in electrolyte in an electroplating chamber; supplying current to cause metal to electroplate onto the substrate; flowing electrolyte into a plating gap defined between the substrate and an opposing surface positioned under the substrate such that the electrolyte impinges upon the substrate, and flowing electrolyte from a periphery of the plating gap through a peripheral passage positioned radially outside of the substrate support, where electrolyte flows through the peripheral passage before reaching an electrolyte-air interface, where the peripheral passage has a dimensionless peripheral passage parameter of at least about 2; where during electroplating, air does not travel through the peripheral passage and under the substrate.

In some embodiments, the peripheral passage is at least partially defined by the substrate support. In these or other cases, the peripheral passage may be at least partially defined by a ring positioned radially outside of the substrate support. For instance, the ring may be a dual cathode clamp ring or a shielding ring. The ring may be made of an insulating material.

In certain implementations, the opposing surface positioned under the substrate is a surface of a channeled ionically resistive plate (CIRP), the CIRP including a plurality of through-holes, where electrolyte flows from below the CIRP, through the through-holes of the CIRP, and into the plating gap. At least a portion of the through-holes may be oriented at a non-normal angle with respect to the substrate in some implementations. In various embodiments, the substrate is rotated during electroplating.

These and other features will be described below with reference to the associated drawings.

BRIEF DESCRIPTION OF THE DRAWINGS

FIGS. 12A and 12B show experimental results related copper films plated at various conditions using baseline and modified hardware as described herein.

DETAILED DESCRIPTION

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The following detailed description assumes the invention is implemented on a wafer. However, the invention is not so limited. The work piece may be of various shapes, sizes, and materials. In addition to semiconductor wafers, other work pieces that may take advantage of this invention include various articles such as printed circuit boards, magnetic recording media, magnetic recording sensors, mirrors, optical elements, micro-mechanical devices and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Certain electroplating processes utilize electrolyte having low metal ion concentrations. These electrolytes are particularly useful when plating on very thin seed layers. For instance, in various cases the seed layer may be between about 1-10 nm thick, for example between about 2-5 nm thick. Unfortunately, the use of low metal ion concentration electrolyte results in a relatively low limiting current, which results in relatively long processing times and a low throughput. In some cases, the limiting current for such electrolytes may be between about 0.7-15 A for 300 mm wafers (or between about 1-25 mA/cm$^2$ in terms of current density), depending on the composition of the electrolyte and the rotation speed of the substrate. Various embodiments herein are presented in the context of electroplating copper. However, the invention is not so limited, and the disclosed methods and apparatus may also be used to electroplate other materials including, but not limited to, cobalt, nickel, gold, silver, and metal alloys.

Figure 1:
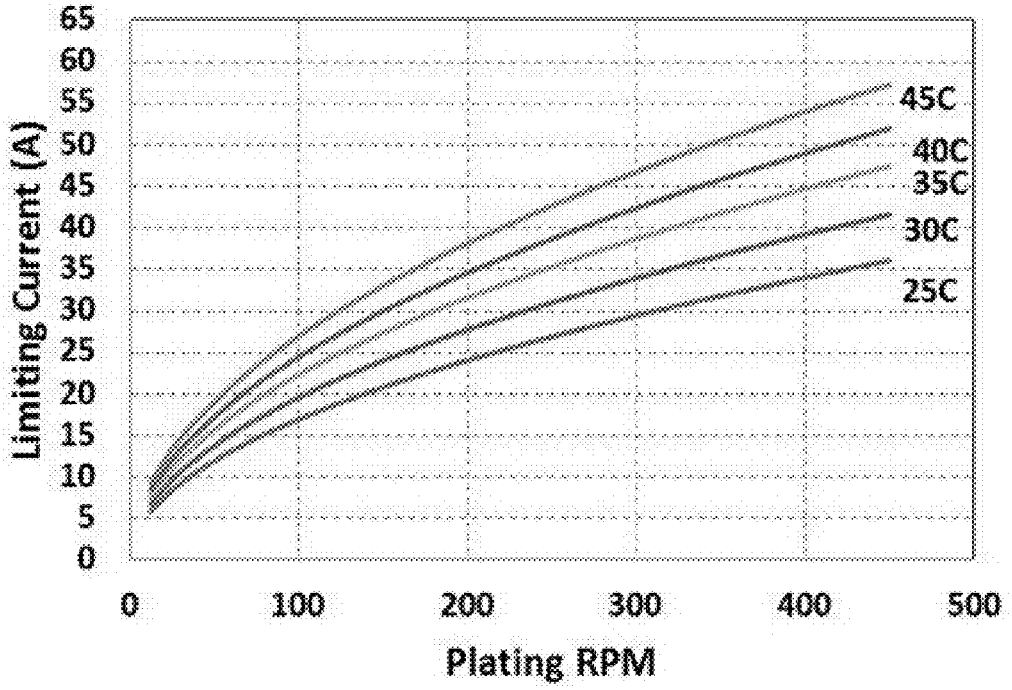
FIG. 1 is a graph showing the limiting current vs. plating RPM at different temperatures.

FIG. 1 presents a chart illustrating the limiting current at different electrolyte temperatures for an electrolyte having the following properties: 5 g/L Cu2+, 10 g/L acid, and 50 ppm Cl ions. The graph includes both experimental results and data extrapolated based on the experimental results. The experimental results that were obtained followed the correlation predicted by the Levich Equation, presented as Equation 1:

$$i_{l,c}=0.620nFAD_0^{2/3}\omega^{1/2}\nu^{-1/6}Co^* \quad \text{(Eq 1)}$$

Where $i_{l,c}$=limiting current of a rotating disk electrode n=number of charge (2 for the reduction reaction from $Cu^{2+}$ to $Cu^0$)

F=Faraday constant, F=9.6485×10$^4$C mol$^{-1}$

A=Surface area of the electrode $D_0$=diffusion coefficient of metal ions

ω=substrate rotation speed

ν=viscosity of electrolyte, and

Co*=metal ion concentration in bulk electrolyte

The experiments involved determining the limiting current at about 25° C. and an electrolyte flow rate of about 6 LPM. The limiting current was determined at various different substrate rotation rates between about 12-175 RPM. This data closely followed the correlation predicted by the Levich Equation, which was used to extrapolate the data at the higher substrate rotation rates shown in FIG. 1. The experiments also involved determining the limiting current at a substrate rotation rate of about 120 RPM at temperatures of 25° C., 30° C., and 35° C. This data showed a linear relationship between limiting current and temperature, and this linear relationship was used to extrapolate the data at 40° C. and 45° C.

Notably, the limiting current scales with the square root of the substrate rotation speed (ω). As the substrate rotation speed increases, the limiting current also increases.

Where currents higher than the limiting current are used, metal ion depletion may occur. Metal ion depletion arises when the mass transfer of metal ions to the plating surface is too low for the given current (e.g., when the metal ion concentration is too low, or when the electrolyte is insufficiently turbulent) such that there is insufficient metal ion concentration at the plating surface to sustain the reduction reaction. Where this is the case, parasitic reactions begin to occur to sustain the current delivered to the substrate. For example, the electrolyte itself may begin to decompose and generate gases at the plating interface, which can result in significantly non-uniform plating and even nodular growths on the substrate in some cases.

One method for increasing the throughput when electroplating with low metal ion concentration electrolyte is to increase the rate at which a substrate is rotated during electroplating. Substrate rotation is commonly used during electroplating to help provide uniform plating results over the face of the substrate. The use of high rate substrate rotation is beneficial at least because it increases the mass transfer within the electrolyte, thereby increasing the limiting current for the system and reducing the risk of metal ion depletion at the plating interface.

However, the use of higher rates of substrate rotation presents certain problems not encountered at lower rates of rotation. Specifically, at higher rates of rotation, air bubbles are much more likely to become trapped under the substrate. These entrained air bubbles have greater resistance than the electrolyte, and can therefore lead to higher plating voltages, which can sometimes exceed the voltage limits of the power supply, leading to failure of the electroplating process. Further, even if the electroplating process does not fail entirely, the presence of entrained bubbles under the substrate surface leads to significant plating non-uniformities and low quality plating.

Figure 2:
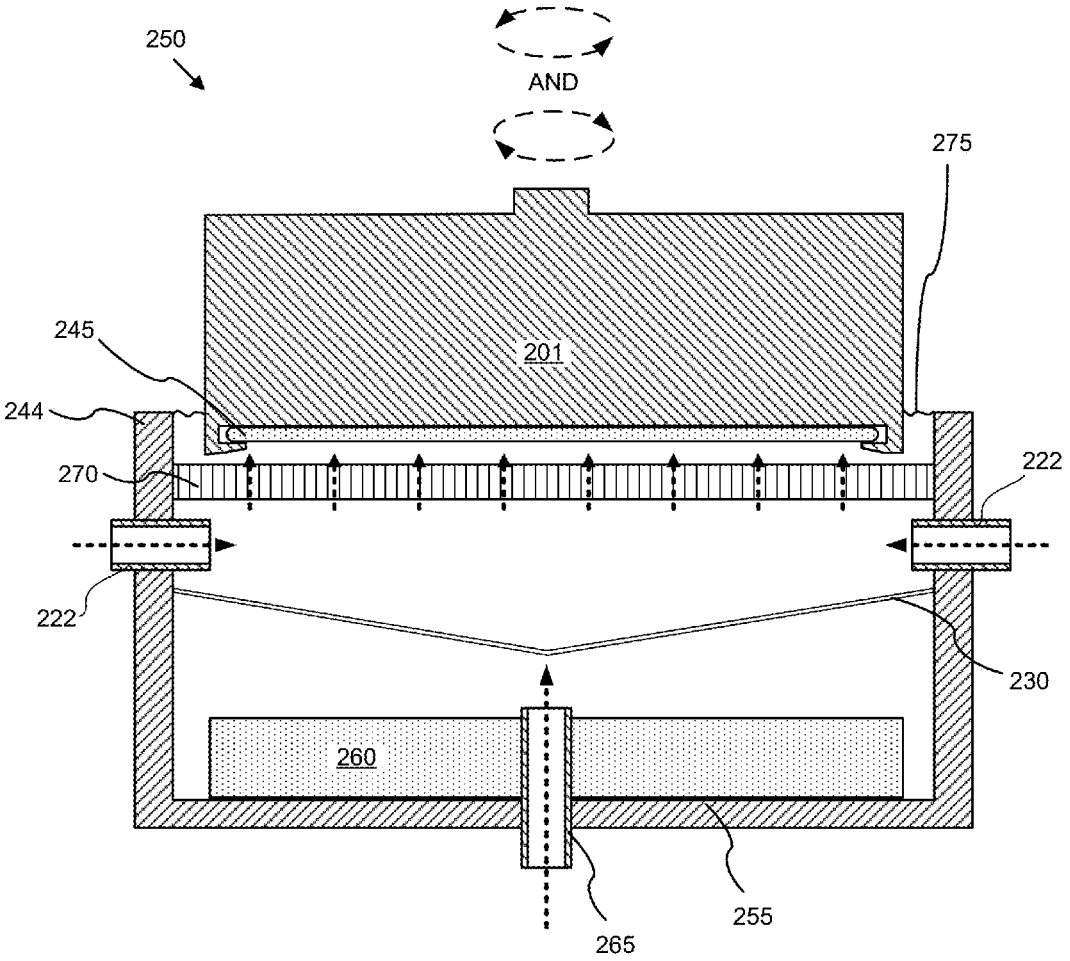
FIG. 2 shows a simplified cross-sectional view of an embodiment of an electroplating chamber.

FIG. 2 provides a simplified view of an electroplating apparatus 250. As depicted in FIG. 1, electroplating plating apparatus 250 includes a plating cell 255 having weir walls 244 and housing anode 260. In this example, electrolyte 275 is flowed into cell 255 centrally through an opening in anode 260 using channel 265, and exits through one or more ports (not shown) under the membrane 230. A separate flow of electrolyte 275 may be provided through one or more inlets 222 above the membrane 230. This electrolyte 275 passes upward through a channeled ionically resistive element 270 having vertically oriented (non-intersecting) through holes through which electrolyte flows and then impinges on wafer 245, which is held in, positioned, and moved by, wafer holder 201. The plating face of the substrate 245 is held in a substrate plating plane.

In these or other cases, electrolyte may also be delivered through one or more inlets (not shown) positioned above the channeled ionically resistive element 270. In some cases, an inlet and outlet are provided above the channeled ionically resistive element, the inlet and outlet being positioned on opposite sides of the plating face of the substrate, such that electrolyte enters at one edge of the substrate, travels across the plating face of the substrate, then exits at the outlet on the opposite side of the substrate. The outlet may provide less resistance to exiting electrolyte (e.g., a wider opening, or the only available opening) compared to other areas (i.e., areas that are not the outlet or inlet) around the periphery of the substrate. Such cross-flowing electrolyte is beneficial in certain embodiments for improving flow and plating uniformity. Any combination of these electrolyte inlets may be used.

Channeled ionically resistive elements such as 270 can be used to provide uniform impinging flow upon the wafer plating surface. In some cases, channeled ionically resistive elements include vertically oriented, non-intersecting through-holes. In other cases, the through holes may intersect. In some embodiments, the through-holes may be angled such that electrolyte leaving the through holes is directed toward the substrate at a non-normal angle. Such angled through holes may be present on the entire channeled ionically resistive element, or on only a portion (or portions) of the element. For instance, in some cases the channeled ionically resistive element includes angled holes near the center portion of the element, and vertically oriented holes outside of this center portion. Further, a mix of angled and vertically oriented through holes may be present on certain portions of the element. In another example, the center portion of a channeled ionically resistive element includes both angled through-holes and vertically oriented through-holes, with only vertically-oriented through holes present in regions outside of the center portion of the channeled ionically resistive element. Where angled through-holes are used, the angled holes may point in the same or different directions. The holes may be radially symmetric in some cases.

Channeled ionically resistive elements, sometimes referred to as high resistance virtual anodes (HRVAs) are further discussed in the following U.S. Patents and Patent Applications, each of which is incorporated herein by reference in its entirety: U.S. Pat. No. 8,308,931; U.S. Pat. No. 8,475,636; and U.S. patent application Ser. No. 14/251,108, filed Apr. 11, 2014, and titled "ANISOTROPIC HIGH RESISTANCE IONIC CURRENT SOURCE (AHRICS)." Electroplating apparatus utilizing cross-flowing electrolyte above the channeled ionically resistive element are further discussed in the following U.S. Patents and Patent Applications, each of which is herein incorporated by reference in its entirety: U.S. Pat. No. 8,795,480; U.S. patent application Ser. No. 13,893,242, filed May 13, 2013, and titled "CROSS FLOW MANIFOLD FOR ELECTROPLATING APPARATUS"; and U.S. patent application Ser. No. 14/103,395, filed Dec. 11, 2013, and titled "ENHANCEMENT OF ELECTROLYTE HYDRODYNAMICS FOR EFFICIENT MASS TRANSFER DURING ELECTROPLATING."

Detrimental air bubble entrainment is more likely to occur at high rates of substrate rotation for several reasons. First, at higher RPMs, the electrolyte is more turbulent, making the surface of the electrolyte more choppy/agitated and less smooth. This increases the risk that the electrolyte-air interface dips below the surface of the substrate, at which point the air can get under the substrate and become entrained. By contrast, at lower RPMs, the electrolyte-air interface is somewhat smoother, with less risk that the interface dips to a point at which air can get under the substrate.

Figure 3:
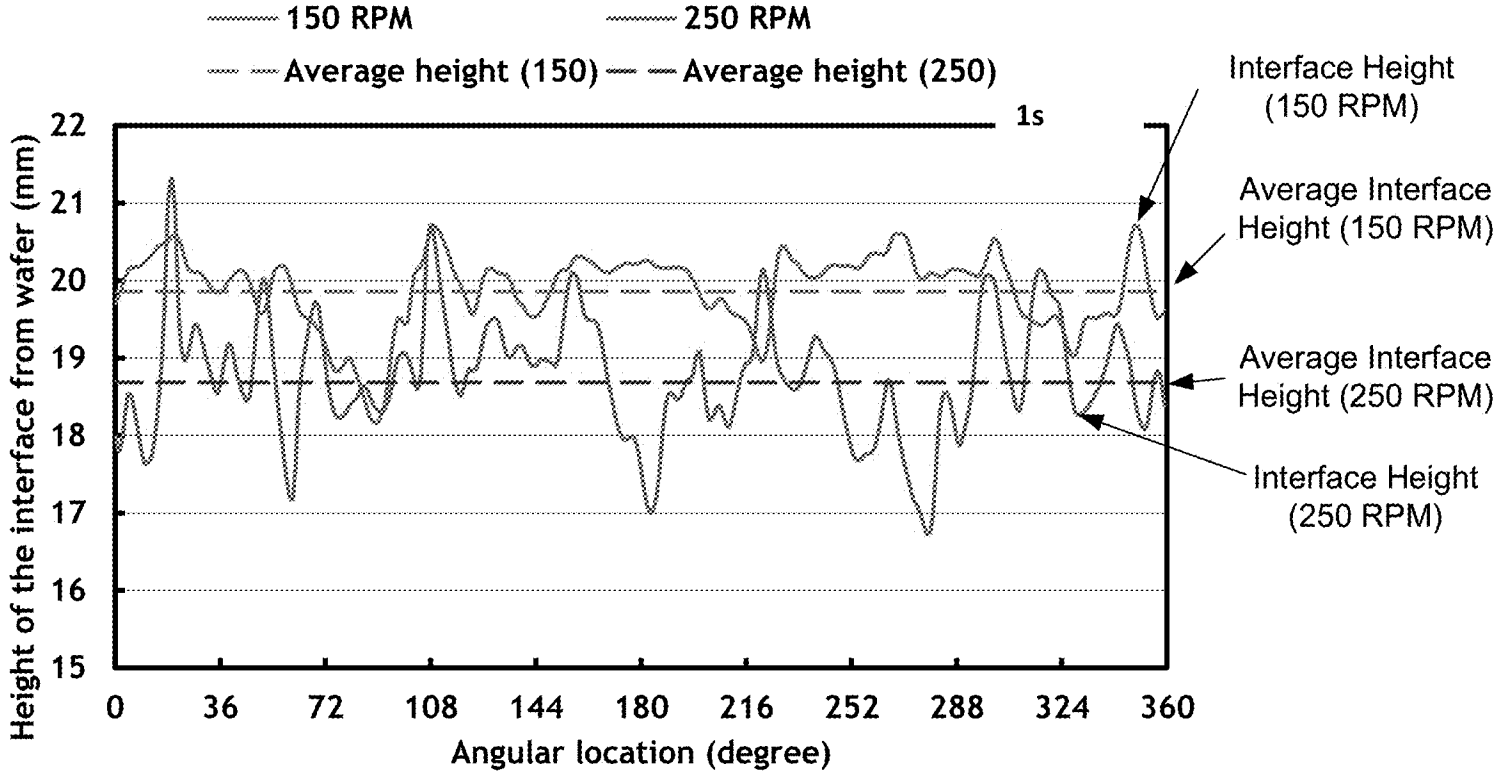
FIG. 3 depicts modeling results related to the instantaneous position of an electrolyte-air interface at different substrate rotation rates.

FIG. 3 presents modeling results that show the height of the electrolyte-air interface at different angular locations around the substrate where two different rotation speeds are used (150 RPM and 250 RPM). The data was generated using a volume of fluid (VOF) multiphase model, mass conservation equations/momentum conservation equations/Navier-Stokes equations (three equations for three spatial coordinates, x, y, and z). The model was solved to determine the different fluid distributions in a multi-phase flow context.

The height referenced in FIG. 3 is the distance between the substrate surface and the electrolyte-air interface after 1 second of substrate rotation in electrolyte. Air bubbles have a chance to become entrained under the substrate whenever the air-electrolyte interface dips below the substrate. The solid lines show the interface height at different angular locations, and the horizontal dotted lines show the average interface height in each case. In addition to being rougher/choppier, the interface in the 250 RPM case is lower (on average) compared to the smoother, higher interface in the 150 RPM case. This lower average position of the interface also contributes to the increased likelihood that air bubbles will become entrained under the substrate. Another possible reason that air bubble entrainment is worse at higher RPMs is that it is more difficult at high RPMs for any air bubbles that make it under the substrate to escape. Because the electrolyte is significantly denser than the air, the electrolyte is pushed outward (toward the substrate periphery) and the air is pushed inward (toward the center of the substrate) due to the rotation of the substrate, much like in a centrifuge. At higher RPMs this phenomenon is more pronounced, and there is less likelihood that any bubbles that get trapped under the substrate are able to escape. For at least these reasons, air bubble entrainment is a more significant problem at higher RPMs.

Another factor that affects the likelihood of air bubble entrainment is the flow rate of electrolyte through the electroplating apparatus. Specifically, air bubbles are more likely to be a problem when the flow rate of electrolyte is relatively low. One reason is that where the flow rate of electrolyte is higher, the electrolyte exiting at the substrate periphery has greater momentum, making it more difficult for air to get under the substrate.

Figure 4:
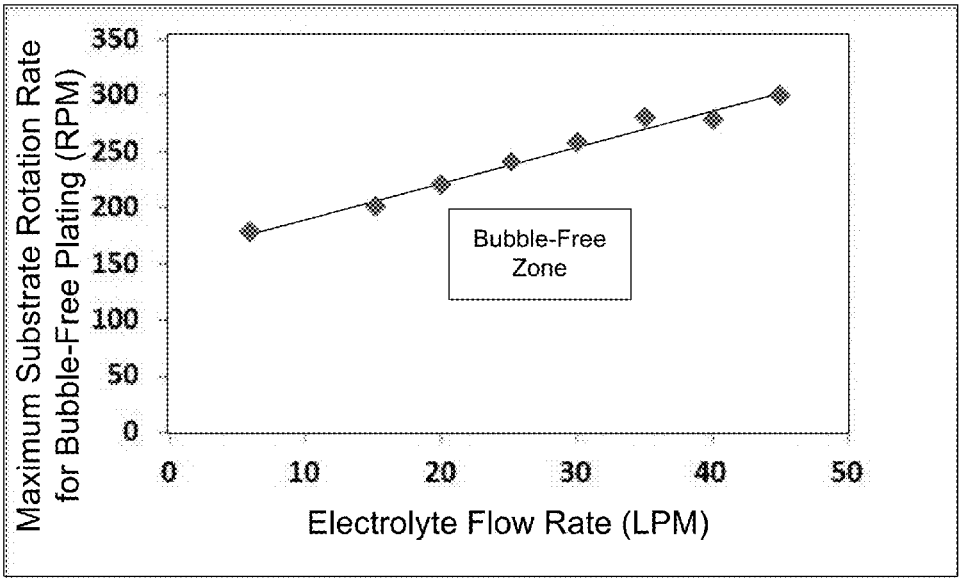
FIG. 4 is a graph illustrating the maximum substrate rotation rate for bubble-free plating vs. different electrolyte flow rates.

FIG. 4 presents a graph illustrating the maximum rate of substrate rotation vs. the flow rate of electrolyte in the apparatus shown in FIG. 2. The flow rate of electrolyte is also sometimes referred to as the pump rate. In FIG. 4, the bubble-free plating zone is represented by the area under the curve. The electrolyte flow rate relates to the amount of electrolyte 275 that travels up through the channeled ionically resistive plate 270 (CIRP, also sometimes referred to as a high resistance virtual anode or HRVA) and into the plating gap positioned between the CIRP 270 and substrate 245. The height of the plating gap is often on the order of about 0.5-6 mm, e.g., 1-2 mm, and is measured as described below. In the apparatus used to generate the data in FIG. 4, the plating gap had a height of about 2 mm. The CIRP 270 used to collect the data in FIG. 4 includes vertically oriented, non-intersecting through holes. In other cases, some or all of the through holes may be angled, as mentioned above. Electrolyte 275 travels through the through holes of the CIRP 270 and into the plating gap where the electrolyte 275 impinges upon the surface of the substrate 245. The electrolyte 275 is then pushed outwards toward the periphery of the substrate and exits the plating gap at the periphery of the substrate 245. The data in FIG. 4 illustrate that the maximum substrate rotation rate increases with the pump rate, as described above. The data shown relates to an apparatus where the plating gap is about 2 mm tall.

Another parameter that affects the likelihood of bubble entrainment is the height of the plating gap. This height is measured as the vertical distance between the plating face of the substrate and an upper surface of an element over which electrolyte flows before exiting the gap. This upper surface is often positioned at or near the periphery of the CIRP 270, and in many cases is a shielding ring/insert (e.g., see element 930 in FIGS. 9A, 9B, 10A, and 10B, element 911 in FIGS. 9C and 9D, and element 1011 in FIGS. 10C and 10D). In certain applications, the CIRP is a dome shape, and the distance between the CIRP and the substrate is non-uniform (though the height of the gap is considered to be uniform since it is measured between the substrate and the top surface of the shielding ring/insert that sits atop the domed CIRP at its periphery). In other applications, the CIRP is substantially flat and the distance between the plating face of the substrate and the CIRP is substantially uniform.

Figure 5:
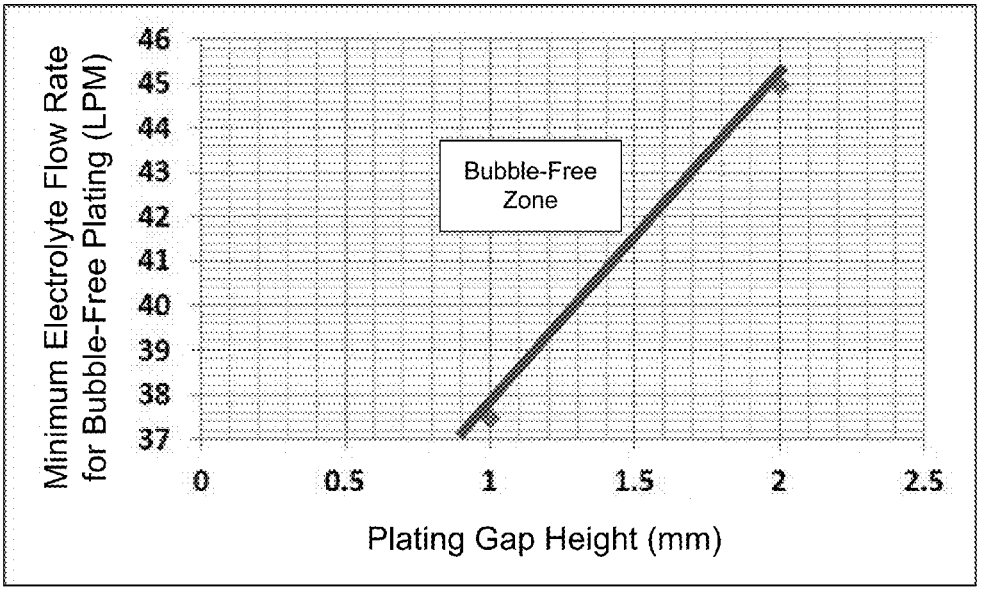
FIG. 5 is a graph showing the minimum electrolyte flow rate for bubble-free plating vs. different plating gap heights.

FIG. 5 shows a graph illustrating the minimum electrolyte flow rate for bubble-free plating at 300 RPM vs. the height of the plating gap. The bubble-free plating zone is represented in this graph as the area above the curve. Where the plating gap is smaller, the minimum pump rate for bubble-free plating is lower. This may be because electrolyte exiting a smaller gap has greater velocity/momentum, making it more difficult for air to travel through the relevant path and under the substrate.

Figure 6:
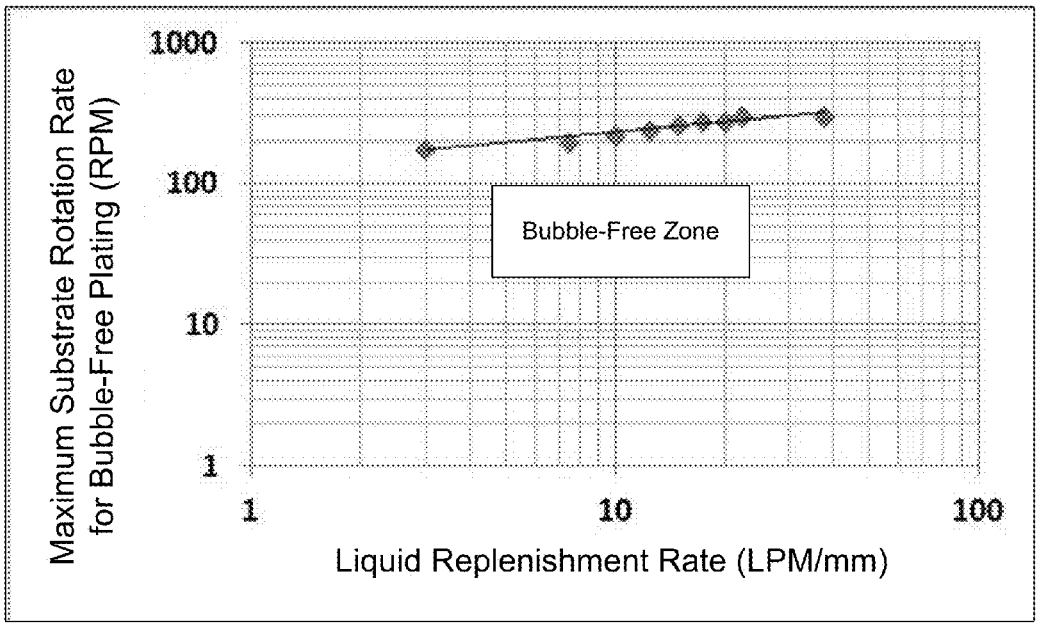
FIG. 6 is a graph depicting the maximum substrate rotation rate for bubble-free plating vs. the liquid replenishment rate.

A related parameter that affects the likelihood of bubble entrainment is the liquid replenishment rate, which is proportional to the flow rate of electrolyte passing through the plating gap divided by the height of the plating gap. FIG. 6 presents the maximum substrate rotation rate for bubble-free plating vs. the liquid replenishment rate. The bubble-free plating zone is represented in this figure by the area under the curve. The results show that the maximum substrate rotation rate for bubble-free plating ($RPM_{max}$) is related to the liquid replenishment rate (LRR). In particular, the $RPM_{max} \propto LRR^{1/4}$.

Figure 7A:
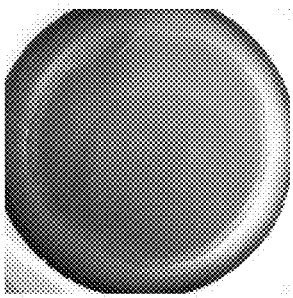
FIGS. 7A-7F illustrate a substrate surface at different points in time during an electroplating process at a high substrate rotation rate.
Figure 7B:
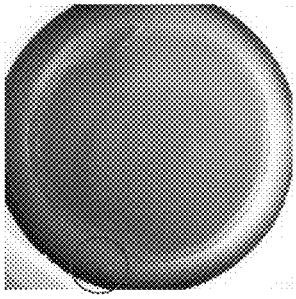
Figure 7C:
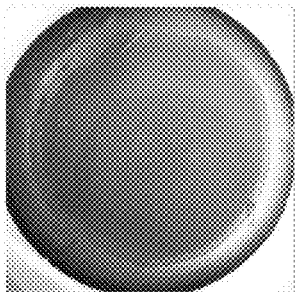
Figure 7D:
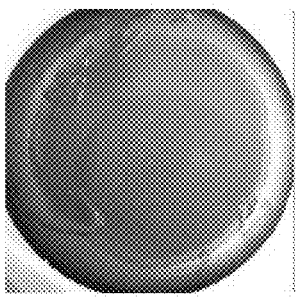
Figure 7E:
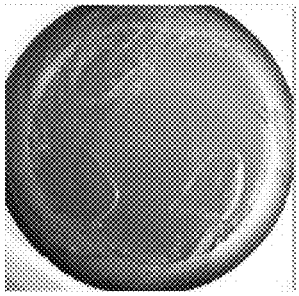
Figure 7F:
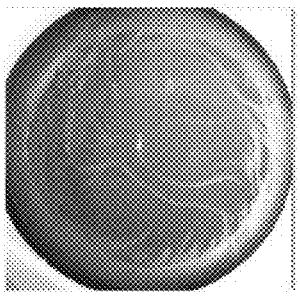

FIGS. 7A-7F present a substrate at different times during an electroplating process in which air bubble entrainment is a problem. FIG. 7A shows the substrate at t=0 s, when the electroplating process first begins. There are no air bubbles at this time. The subsequent figures present the same substrate at later times in the electroplating process. FIG. 7B shows the substrate when t=5 s. At this point the substrate is rotating at a high RPM, and evidence of the first air bubble appears near the bottom of the substrate, which is circled in FIG. 7B. FIG. 7C shows the substrate when t=13 s. At this point more air bubbles are becoming entrained along the edge of the substrate. When t=17 s, as shown in FIG. 7D, the air bubble entrainment is progressively worse, and the quality of plating is fairly poor. When t=19 s, as shown in FIG. 7E, the air bubble entrainment is worse still, and the quality of the electroplated material is bad. When t=28 s, as shown in FIG. 7F, the air bubble entrainment is extreme and the quality of electroplated material is terrible. Air bubble entrainment can lead to very poor film quality including poor film thickness uniformity, high defect density, and even failure of the electroplating process in some cases.

Figure 8:
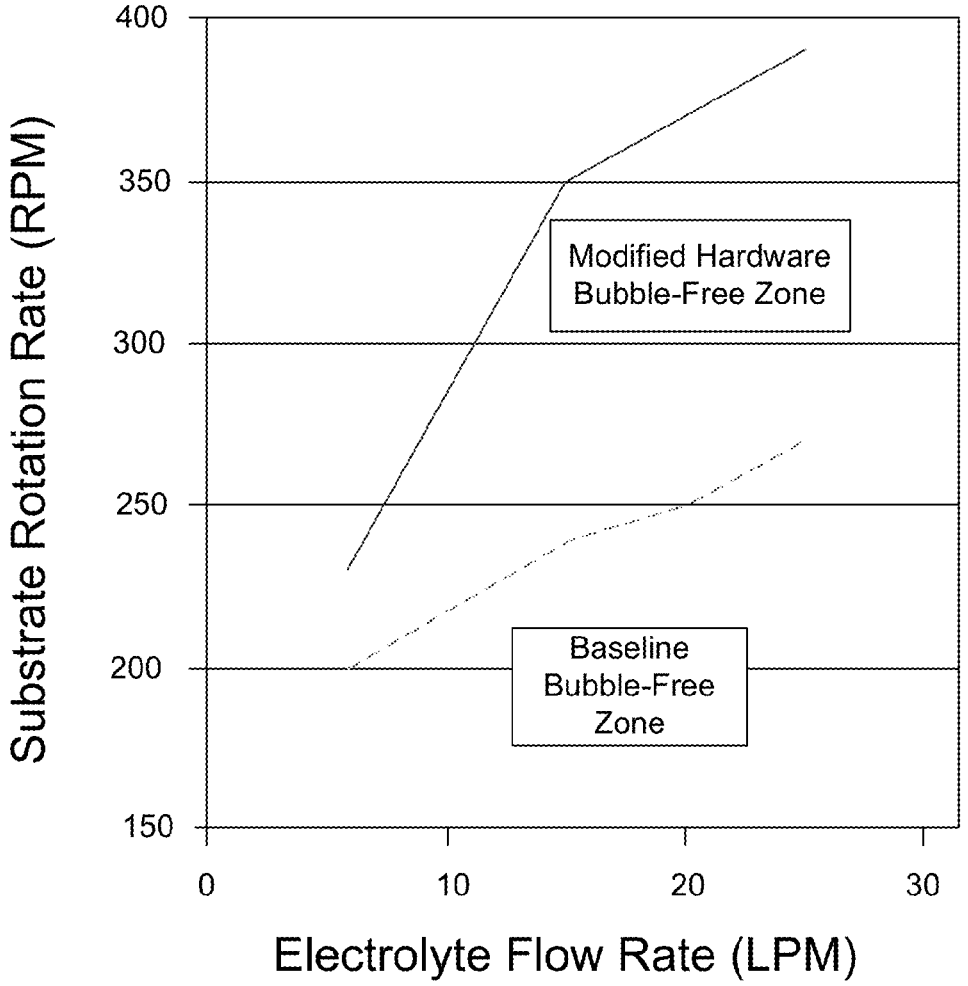
FIG. 8 shows experimental results illustrating the maximum substrate rotation rate for bubble free plating at different electrolyte flow rates where baseline hardware is used and where modified hardware is used.

FIG. 8 presents data showing the "bubble-free zone" in terms of RPM and electrolyte flow rate for two different hardware configurations. The bubble-free zones are the areas under each curve. The bubble-free zones represent processing windows that can be used to electroplate without the risk of bubble entrainment. In the baseline case (shown by the dotted line), bubble-free plating can occur up to a substrate rotation rate of about 270 RPM at high flow rates (e.g., about 25 LPM). In a case where modified hardware is used (shown by the solid line), the bubble-free plating zone is much larger, and bubble-free plating can occur up to a substrate rotation rate of about 390 RPM at high flow rates (e.g., about 25 LPM). At a moderate flow rate of 15 LPM, bubble-free plating can occur up to about 240 RPM in the baseline case, and up to about 350 RPM in the modified hardware case. In other words, at the 15 LPM flow rate, the modified hardware can achieve bubble-free plating at substrate rotation rates up to about 45% higher than can be used in the baseline case. The hardware modifications are described further herein. Briefly, in various embodiments the hardware modifications relate to the shape and dimensions of the fluid paths for electrolyte exiting at the periphery of the substrate. The fluid paths may be shaped by various elements including, for example, a substrate holder, a CIRP, and a ring positioned proximate the periphery of the CIRP and/or substrate holder. These parts can be configured such that the fluid path for electrolyte exiting at the periphery of the substrate is relatively taller and narrower than what has been used previously. A tall/narrow fluid path minimizes the risk that air will travel down this path and under the substrate.

Figure 9A:
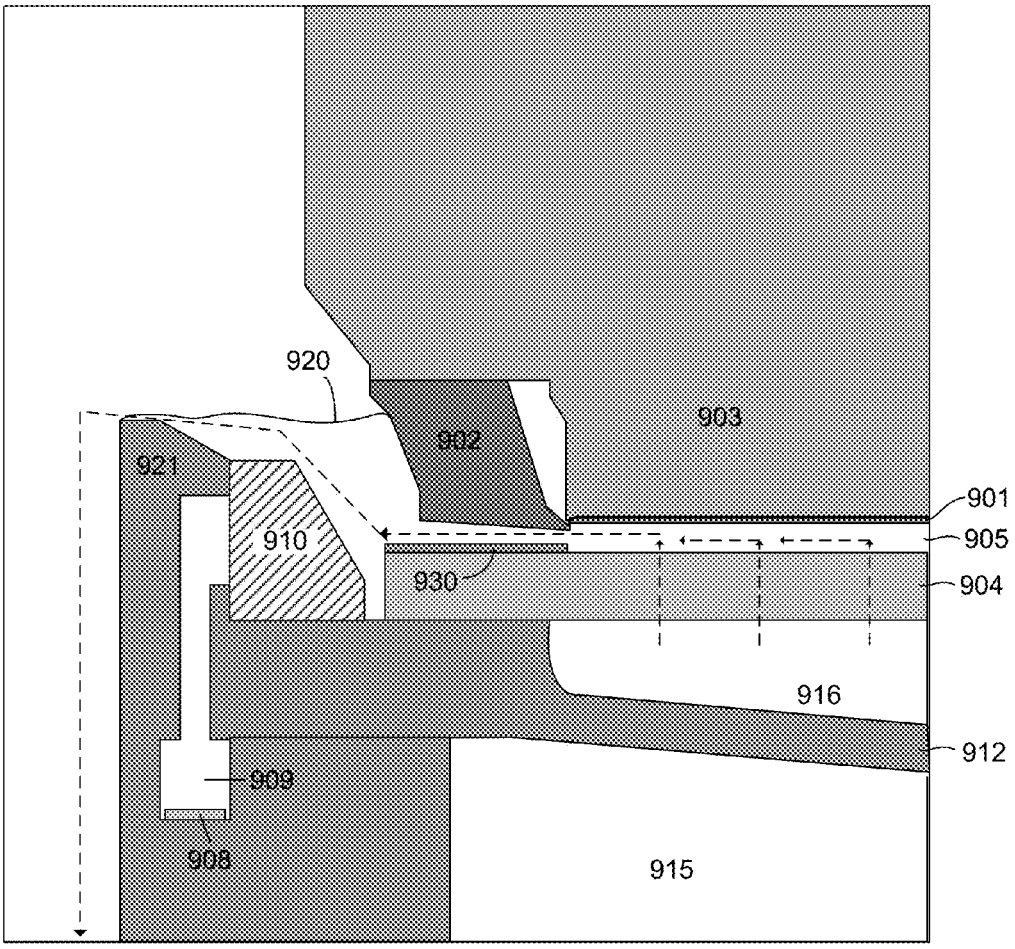
FIG. 9A shows a close-up view of a portion of a baseline electroplating apparatus having a flat high resistance virtual anode (HRVA) plate.

FIG. 9A shows a close-up cross-sectional view of a portion of an electroplating apparatus having hardware that is described herein as a baseline flat CIRP design (or more simply as a baseline design). A substrate 901 is supported at its periphery by annularly shaped substrate support 902. Substrate support 902 is also sometimes referred to as a cup. A cone 903 contacts and presses down on the back side of the substrate 901 to secure the substrate 901 in the substrate support 902. A plating gap 905 exists between a channeled ionically resistive plate (CIRP) 904 and the substrate 901. Near the periphery of the CIRP 904, the plating gap 905 is defined between the substrate 901 and a shielding ring 930 (sometimes also referred to as an insert or insulating insert). As noted above, the height of the plating gap in this embodiment is measured as the vertical distance between the plating face of the substrate 901 and the top surface of the shielding ring 930. In which the second sidewall coating 310 is deposited through ALD, the method chosen to deposit the second sidewall coating 310 should allow for the protective layer to be formed deep in the etched feature 302. CVD and other deposition processes may be suitable in various implementations, particularly where the deposition can be carried out in a conformal manner.

Electrolyte is present in an anolyte region 915, a catholyte region 916, and the plating gap 905. The anolyte region 915 and the catholyte region 916 are separated from one another by a membrane 912. The membrane 912 is often a cationic membrane, though other types of membranes may be used as appropriate. In many embodiments, the electrolyte contains certain plating additives, such as accelerators, suppressors, levelers, brighteners, wetting agents, etc. The additives are organic in many cases. It is often beneficial to keep the anolyte substantially free of such additives, such that the additives do not come into contact with the anode, where they are likely to degrade and form unwanted byproducts. The membrane 912 allows for additives to be present in the catholyte region 916 and the plating gap 905 (where they are useful) while maintaining the anolyte region 915 substantially additive-free. Further, the membrane 912 prevents any species generated/present in the anolyte from reaching and contaminating the substrate 901. During plating, electrolyte travels up from the catholyte region 916, through the through-holes in the CIRP 904, and into the plating gap 905. The flow of electrolyte is shown by the dotted lines. After the electrolyte leaves the through-holes in the CIRP 904, the electrolyte impinges upon the plating face of the substrate 901. The electrolyte then travels outward toward the periphery of the substrate (left in FIG. 9A).

Positioned radially outside of the CIRP 904 is an annularly shaped ring 910. In the embodiment of FIG. 9A, ring 910 is a piece of hardware that is sometimes referred to as a dual cathode clamp 910, or more simply as a DC clamp 910 or DC clamp ring 910. An annularly shaped dual cathode chamber 909 (DC chamber 909) houses an annularly shaped dual cathode 908. The dual cathode 908 helps shape the field lines within the electroplating chamber to promote uniform plating results. Dual cathodes are sometimes referred to as thief cathodes, and are further described in the following patents and patent applications, each of which is herein incorporated by reference in its entirety: U.S. Pat. No. 7,854,828; U.S. Pat. No. 8,475,636, U.S. patent application Ser. No. 13/687,937, filed May 30, 2013, and titled "DYNAMIC CURRENT DISTRIBUTION CONTROL APPARATUS AND METHOD FOR WAFER ELECTROPLATING"; and U.S. patent application Ser. No. 14/067,616, filed Oct. 30, 2013, and titled "METHOD AND APPARATUS FOR DYNAMIC CURRENT DISTRIBUTION CONTROL DURING ELECTROPLATING."

The DC clamp ring 910 contains a series of channels (not shown) to provide ionic communication between the catholyte (which contains plating additives) and electrolyte in the dual cathode chamber 909 (which typically does not contain plating additives). The DC clamp ring 910 also provides a physical barrier (e.g., with an additional membrane (not shown)) between the catholyte and the electrolyte in the dual cathode chamber 909. In this way, the additives do not degrade from coming into contact with the dual cathode, which is often made of titanium, and which may have copper on the outer surface. Another function of the DC clamp ring 910 is to physically hold/clamp the membrane 912 in place to seal the electroplating chamber. In various embodiments the DC clamp ring 910 is made of an insulating material such as plastic, polyethylene, polypropylene, polyvinylidene difluoride (PVDF), polytetrafluoroethylene (PTFE, e.g., Teflon), ceramic, (PET), polycarbonate, glass, etc.

After the electrolyte travels under the substrate holder 902, it travels upward/outward between the substrate holder 902 and the ring 910. From here, the electrolyte may flow over a weir wall 921. The electrolyte may be recycled as appropriate. The electrolyte-air interface is shown by line 920. If any portion of the electrolyte-air interface 920 dips below the bottom surface of substrate holder 902 at any time during plating, air bubbles can become entrained under the substrate 901. In various embodiments, the shape of certain electroplating hardware is modified to alter the shape of the fluid path that the electrolyte follows after traveling past the periphery of the substrate. In particular, the fluid path is modified to be taller/narrower in the region between the substrate holder 902 and the ring 910. This modification makes it more difficult for air at the electrolyte-air interface 920 to reach under the substrate holder 902 where it could become entrained.

Figure 9B:
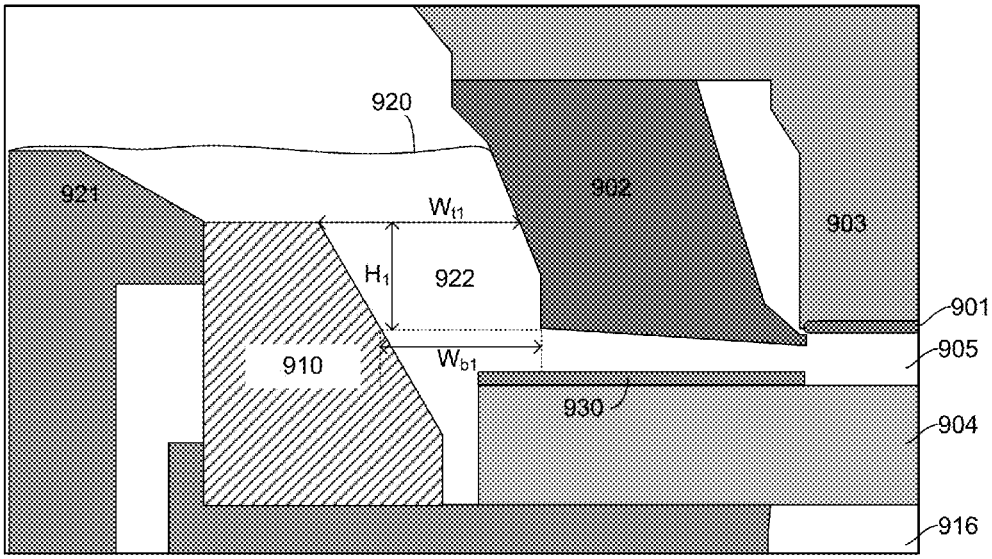
FIG. 9B shows a closer-up view of the peripheral passage shown in FIG. 9A.

FIG. 9B shows a close-up view of a portion of the electroplating apparatus shown in FIG. 9A, with certain dimensions highlighted. The dimensions relate to the shape of the area between the substrate support 902 and the ring 910, referred to herein as the peripheral passage 922. The dimensions therefore describe the shape of a portion of the peripheral passage 922 for electrolyte that exits at the periphery of the substrate 901. Peripheral passage 922 is located peripherally outside of the substrate support 902, and in various embodiments is annularly shaped to extend all the way around the substrate support 902. In the depicted embodiments, peripheral passage 922 has a height (labeled $H_1$ in FIG. 9B) that is measured as the vertical distance between the lower outer corner of the substrate support 902 and the top surface of the ring 910. Peripheral passage 922 may have a variable width due to the variable diameters of the ring 910 and the substrate support 902; the diameters may independently vary in the vertical direction as shown.

The width at the top of the peripheral passage 922 is the horizontal distance between the ring 910 (at its top surface) and the substrate holder 902, labeled in FIG. 9B as $W_{t1}$. The width at the bottom of the peripheral passage 922 is the horizontal distance between the substrate support 902 (at its bottom outer corner) and the ring 910, labeled in FIG. 9B as $W_{b1}$. The peripheral passage 922 has an average width, which can be calculated/measured with a high degree of accuracy. For the sake of simplicity, the average width of the peripheral passage 922 in the examples herein is calculated as the average between the width at the top of the peripheral passage, $W_{t1}$, and the width at the bottom of the peripheral passage, $W_{b1}$. As noted above, certain embodiments herein relate to electroplating methods and apparatus that use a taller, narrower flow path in peripheral passage 922.

Figure 9C:
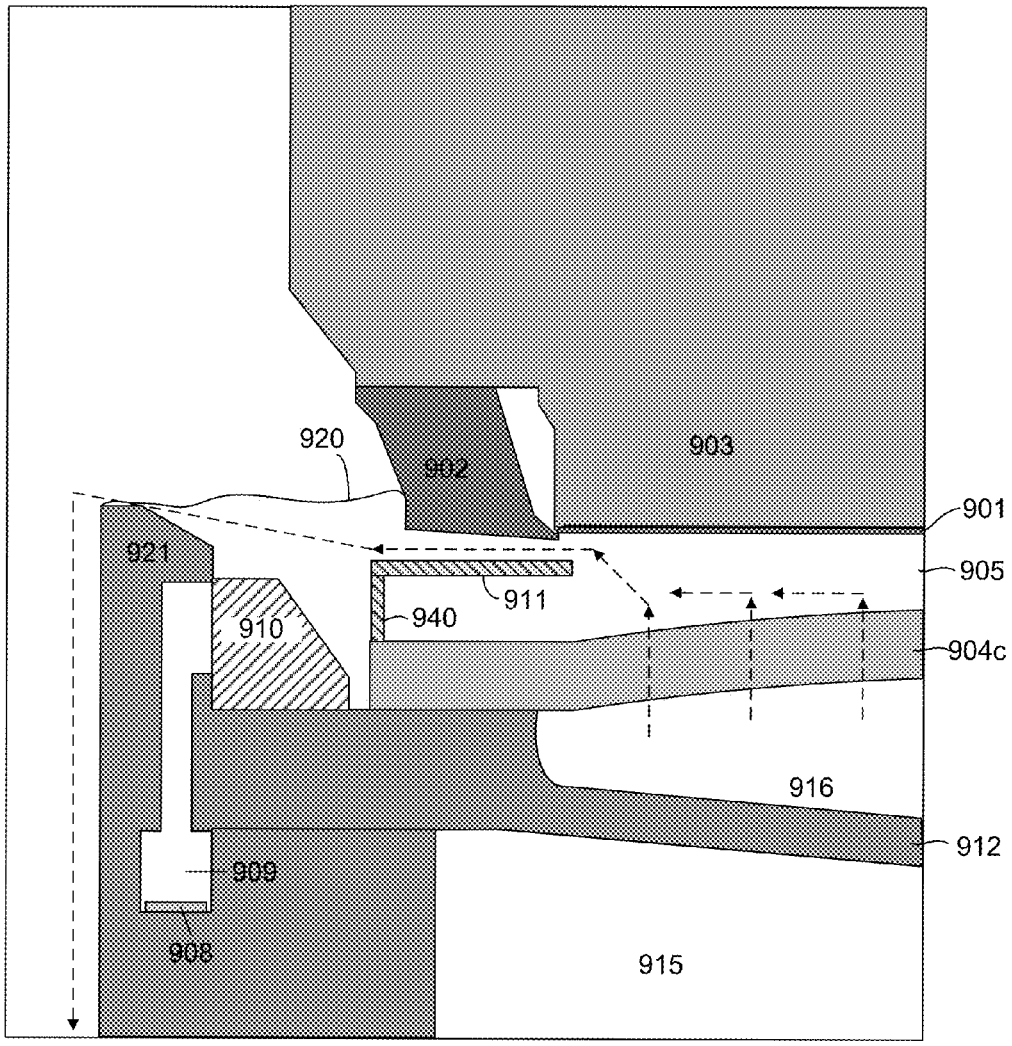
FIG. 9C shows a close-up view of a portion of a baseline electroplating apparatus having a domed HRVA plate with a shielding ring without a step.

FIG. 9C shows a close-up cross-sectional view of a portion of an electroplating apparatus having hardware that is described herein as a baseline domed CIRP design (or more simply as a baseline design). Domed CIRPs are further discussed in U.S. patent application Ser. No. 14/251,108, filed Apr. 11, 2014, and titled "ANISOTROPIC HIGH RESISTANCE IONIC CURRENT SOURCE (AHRICS)," which is herein incorporated by reference in its entirety.

FIGS. 9A and 9C both show baseline designs, with 9A in the context of a flat CIRP and 9C in the context of a domed CIRP. The elements shown in FIG. 9C are very similar to those shown in FIG. 9A, and only the differences will be highlighted. In FIG. 9C, the CIRP is a domed CIRP 904*c*, rather than the flat CIRP 904 shown in FIG. 9A. Further, the shielding ring 911 is shaped differently than the shielding ring 930 in FIG. 9A, and is provided in a slightly different position than in FIG. 9A. In particular, the shielding ring 911 in FIG. 9C includes a spacer portion 940 that positions the horizontally oriented portion of the shielding ring 911 to a height above the domed CIRP 904*c*. Notably, the shielding ring 911 has an upper surface that is above the upper surface of the DC clamp ring 910 in FIG. 9C. By contrast, the hardware in FIG. 9A includes a flat shielding ring 930 that sits right on the surface of the flat CIRP 904, with the upper surface of the shielding ring 930 being positioned vertically lower than the upper surface of the DC clamp ring 910 in FIG. 9A. This shielding ring 911 shields the electric field at the edge of the substrate where the electric field is relatively stronger due to the geometry of various parts. The shielding ring 911 helps make deposition more uniform at different radial locations. Similar shielding rings are present in certain electroplating apparatus that utilize a flat CIRP, as well, as shown by element 930 in FIG. 9A. The shielding ring 911 may also be referred to as an insert, a CIRP insert, or a HRVA insert. In various embodiments the shielding ring 911 is made of an insulating material such as plastic, polyethylene, polypropylene, polyvinylidene difluoride (PVDF), polytetrafluoroethylene (PTFE, e.g., Teflon), ceramic, Polyethylene terephthalate (PET), polycarbonate, glass, etc. (can be the same materials as DC clamps).

Figure 9D:
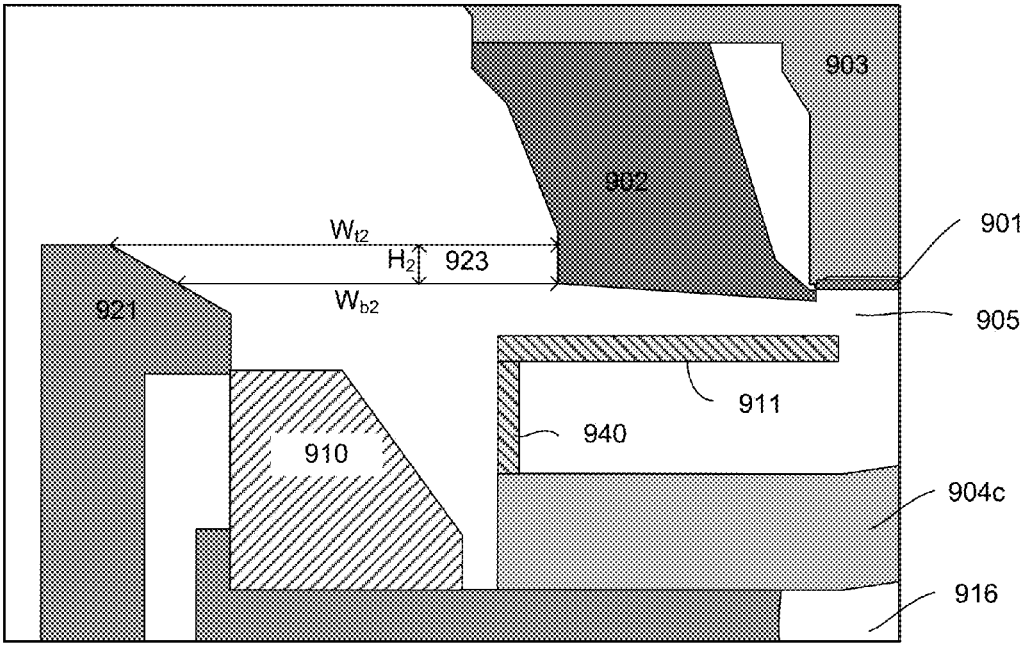
FIG. 9D shows a closer-up view of the peripheral passage shown in FIG. 9C.

FIG. 9D illustrates a close-up cross-sectional view of a portion of the electroplating apparatus shown in FIG. 9C, with certain dimensions highlighted. In FIG. 9D, the electrolyte flows through peripheral passage 923 after passing under the substrate holder 902. In this embodiment, the peripheral passage 923 is positioned between the substrate holder 902 and the weir wall 921. The peripheral passage 923 has a height labeled in FIG. 9D as $H_2$, and a width that is variable due to the shape of the weir wall 921, with the top width labeled as $W_{t2}$, and the bottom width labeled as $W_{b2}$. The height $H_2$ is measured as the vertical distance between the bottom outer corner of the substrate holder 902 and the top surface of the weir wall 921. The width is measured as the horizontal distance between the outer edge of the substrate holder 902 and the inner edge of the weir wall 921 positioned radially outside the substrate holder 902. Where the width is variable, as in FIG. 9D, an average width may be considered. In order to decrease the risk that air bubbles become entrained under the substrate 901, the peripheral passage 923 may be modified to be relatively taller/narrower, as described herein. More specifically, the shape of the peripheral passage 923 may be modified by changing the shape of the shielding ring 911 such that the modified shielding ring creates a taller/narrower fluid passage as shown in FIGS. 10C and 10D, described further below.

With reference to FIGS. 9B and 9D, a dimensionless parameter can be defined to describe the peripheral passages 922 and 923. The dimensionless parameter is referred to herein as the dimensionless peripheral passage parameter, or more simply as the peripheral passage parameter, and it is represented by δ. The peripheral passage parameter is defined as the height of the peripheral passage divided by the average width of the peripheral passage, with the height and width measured as shown in the figures. Generally speaking, the relevant height is the vertical distance between the bottom of the substrate support (i.e., the bottom corner of the cup) and the top surface of a piece of hardware that is radially outside of the substrate support, over which fluid flows, and which defines the outer edge of the peripheral passage (e.g., the relevant hardware defining the top surface is the DC clamp ring 910 in FIGS. 9A and 9B, the DC clamp ring 1010 in FIGS. 10A and 10B, the weir wall 921 in FIGS. 9C and 9D, and the shielding ring 1011 in FIGS. 10C and 10D). This height is measured when the substrate support is in a plating position. The relevant width is the average horizontal distance between the substrate support and the piece of hardware radially outside of the substrate support (and within the same horizontal plane as the bottom portion of the substrate support), the average width being measured over the height of the peripheral passage as explained above. For example, the relevant piece of hardware radially outside the substrate support that helps define the width of the peripheral passage is the DC clamp ring 910 in FIGS. 9A and 9B, the DC clamp ring 1010 in FIGS. 10A and 10B, the weir wall 921 in FIGS. 9C and 9D, and the shielding ring 1011 in FIGS. 10C and 10D.

In various examples herein, the average width of the peripheral passage is calculated (for the sake of simplicity) to be the average between the width at the top of the peripheral passage and the width at the bottom of the peripheral passage, though one of ordinary skill in the art would understand that the average widths can be calculated more accurately. In the context of FIG. 9B, the average width is estimated to be $0.5*(W_{t1}+W_{b1})$, and in FIG. 9D, the average width is estimated to be $0.5*(W_{t2}+W_{b2})$. Therefore, in the context of FIG. 9B, $\delta=H_1/(0.5*(W_{t1}+W_{b1}))$. Similarly, in the context of FIG. 9D, $\delta=H_2/(0.5*(W_{t2}+W_{b2})$.

Where the dimensionless peripheral passage parameter, δ, is higher, the peripheral passage is relatively taller and/or narrower, making it more difficult for air bubbles to travel down through the peripheral passage and under the substrate. As such, by increasing the dimensionless peripheral passage parameter, bubble-free plating can be extended to higher substrate rotation rates. The use of higher substrate rotation rates allows deposition to occur at higher limiting currents, which consequently increases throughput. Therefore, by plating with hardware having a higher dimensionless peripheral passage parameter, throughput can be increased.

Similarly, the electrolyte flow path can be characterized by its tortuosity. Tortuosity relates to the shape of the flow path and how difficult it is for fluid to traverse the flow path. Where the flow path is more tortuous, it is more difficult for air to traverse the path and end up under the substrate. In certain embodiments, the fluid path between the point at which electrolyte passes out from under the substrate and the point at which electrolyte contacts the electrolyte-air interface is designed to be particularly tortuous. For instance, in some cases, the path may have a tortuosity of at least about 1.1, for example at least about 1.2. As used herein, tortuosity ($\tau$) is measured by the arc-chord ratio, which is the ratio of the length of the fluid path (L) to the linear distance between the ends of the path (C): $\tau$=L/C. Tortuosity can be increased by making various modifications to the shape of the fluid path, for example by making variations on the shape of the substrate support/cup, the height and diameter of the weir wall, etc.

Figure 10A:
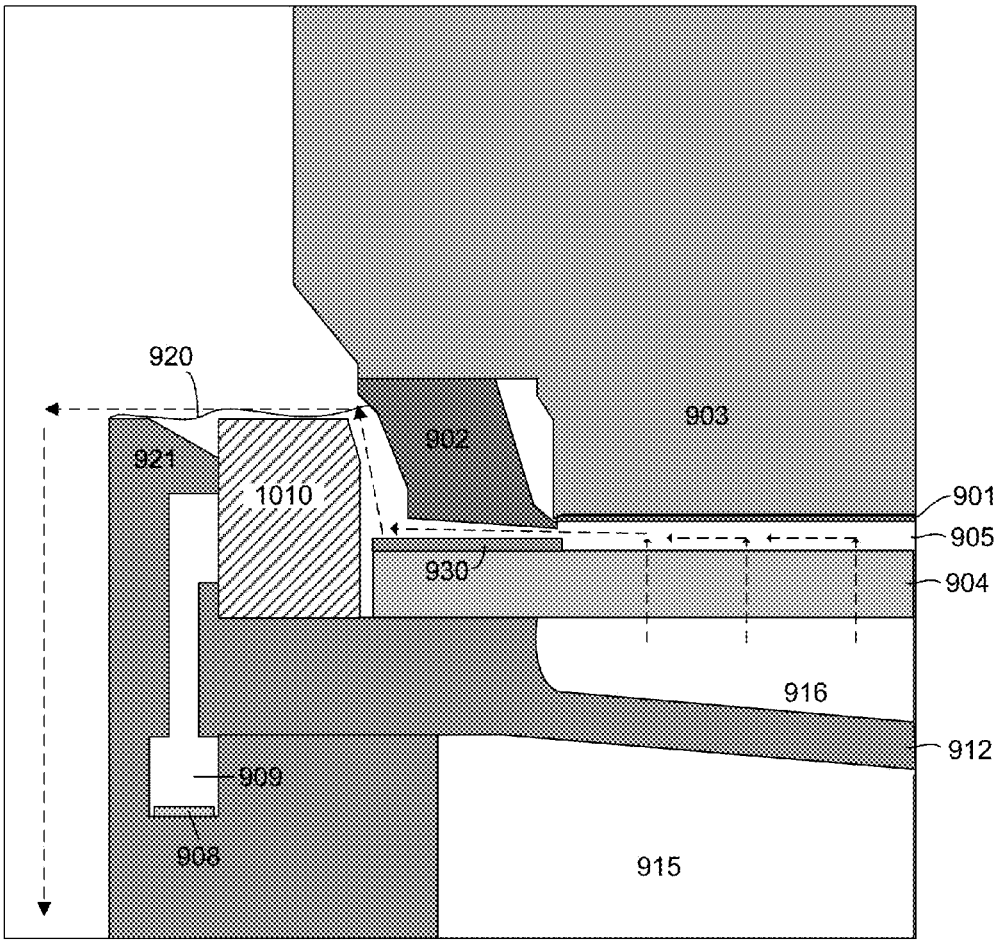
FIG. 10A depicts a close-up view of a portion of a modified electroplating apparatus having a flat HRVA plate with a modified DC clamp ring.
Figure 10B:
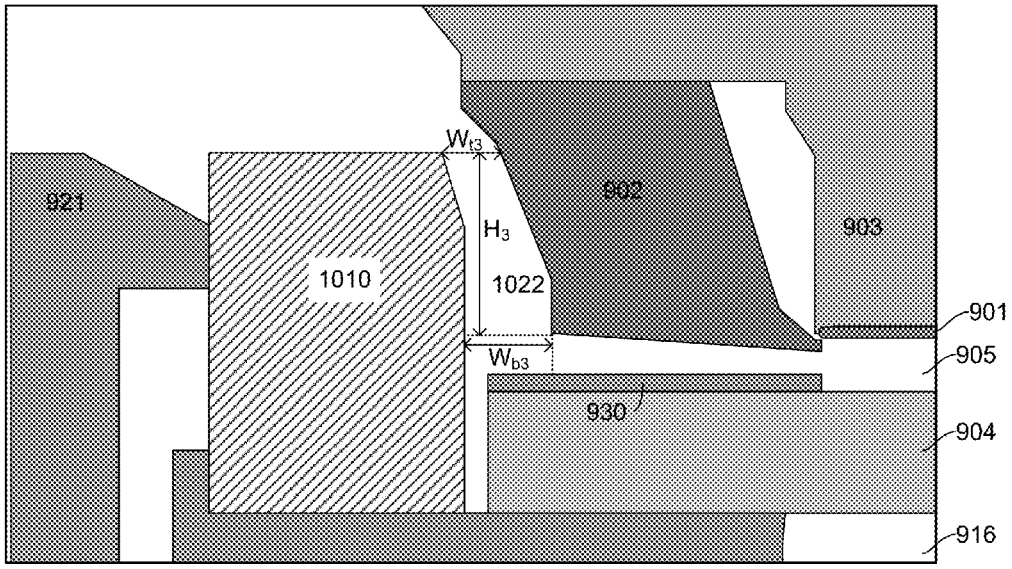
FIG. 10B shows a closer-up view of the peripheral passage shown in FIG. 10A.
Figure 10C:
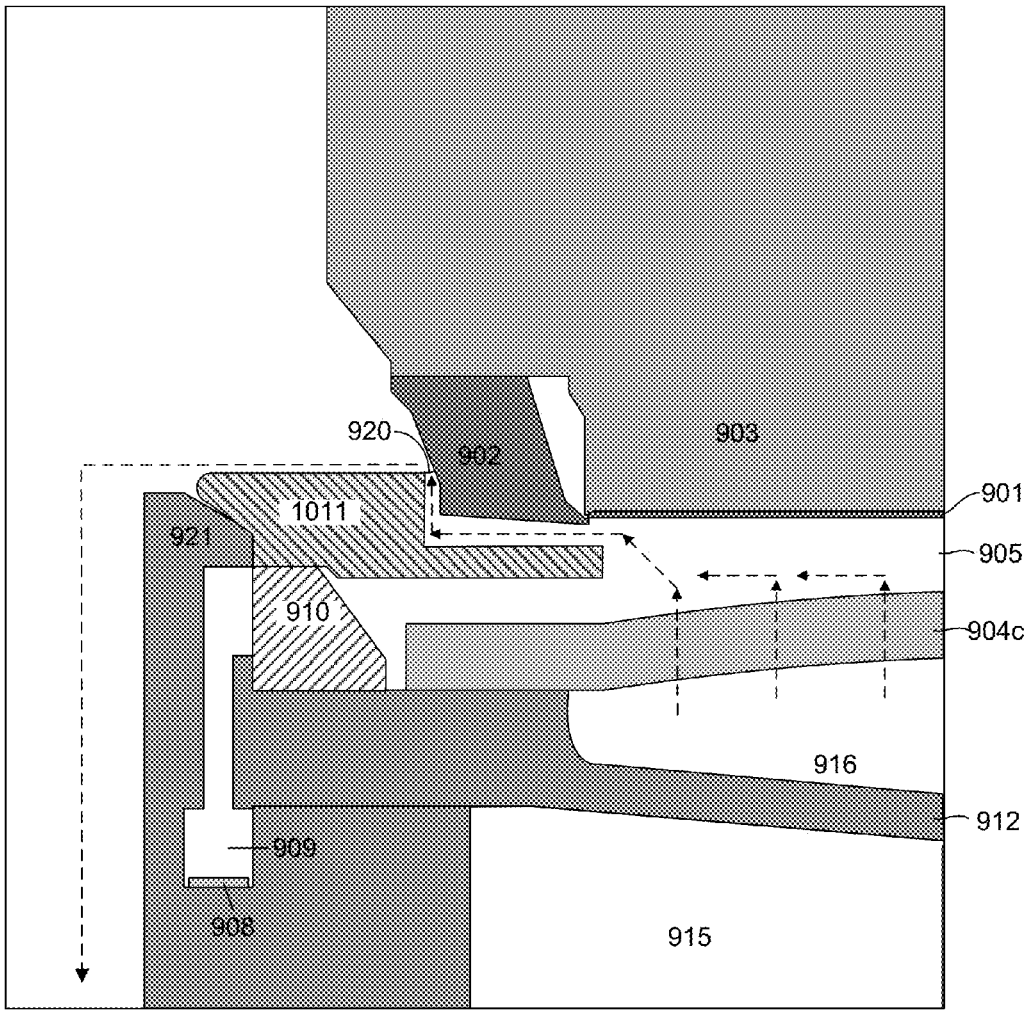
FIG. 10C depicts a close-up view of a portion of a modified electroplating apparatus having a domed HRVA plate with a modified shielding ring.
Figure 10D:
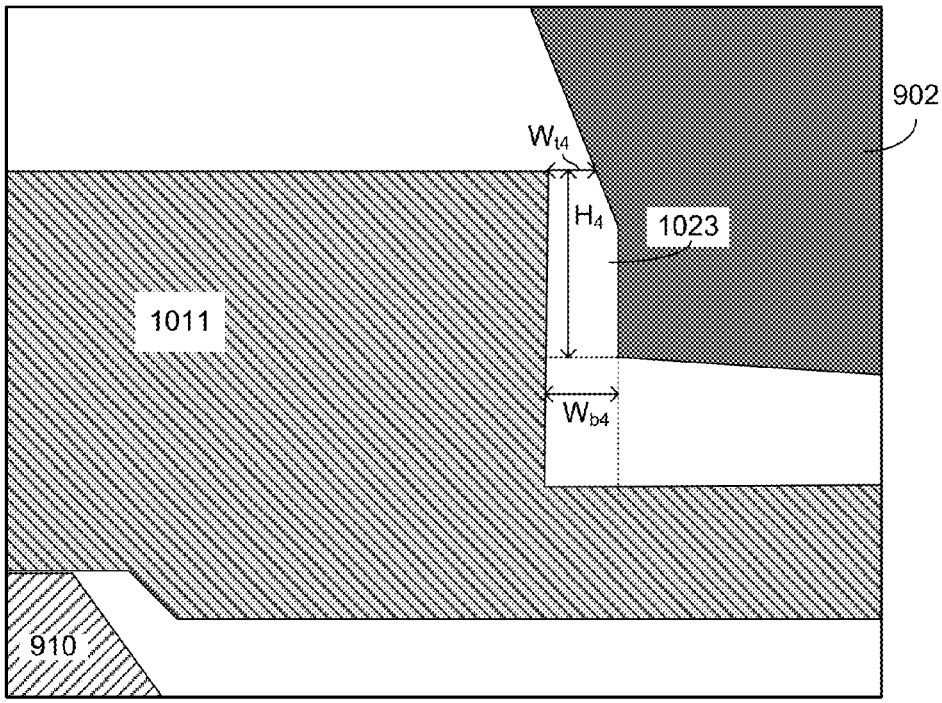
FIG. 10D illustrates a closer-up view of the peripheral passage shown in FIG. 10C.

FIGS. 10A and 10B (close-up) illustrate an embodiment of an electroplating apparatus having a DC clamp ring 1010 that is taller and wider than the DC clamp ring 910 shown in FIGS. 9A and 9B. The resulting peripheral passage 1022 is therefore taller and narrower than the one shown in FIG. 9B. The remaining elements in FIGS. 10A and 10B are the same as those shown in FIGS. 9A and 9B, and the description is omitted for the sake of brevity. The relevant dimensions are highlighted in FIG. 10B. In this embodiment, the dimensionless peripheral passage parameter $\delta=H_3/(0.5*(W_{t3}+W_{b3})$.

In some embodiments where the peripheral passage 1022 is defined between the substrate support 902 and a ring 1010, the peripheral passage 1022 may have a height ($H_3$) between about 0.1-1 inches, for example between about 0.1-0.7 inches. In some cases, the height of the ring 1010, and therefore the height of the peripheral passage 1022 may extend all the way up to the electrolyte-air interface. In this embodiment, the ring 1010 extends up to the same height/vertical position as the weir wall 921. The peripheral passage 1022 may have an average width between about 0.02-0.5 inches, for example between about 0.06-0.22 inches. The dimensionless peripheral passage parameter may be at least about 1.6, at least about 2, at least about 3, or at least about 5 in various embodiments. In some cases the dimensionless peripheral passage parameter may be between about 1.6-10, or between about 2-10, or between about 2-5, or between about 2-3.5, for example between about 2.2-2.6. The above dimensions can be applied to other annular fluid pathways used with substrate holders in electroplating apparatus.

In one particular example of the embodiment shown in FIGS. 10A and 10B, $H_3$=0.6 cm, $W_{t3}$=0.2 cm, $W_{b3}$=0.3 cm, the average width is estimated as $0.5*(W_{t3}+W_{b3})$=0.25 cm, and $\delta$=0.6/0.25=2.4.

FIGS. 10C and 10D (close-up) illustrate an embodiment of an electroplating apparatus having a modified shielding ring 1011 that has a portion radially outside the substrate support 902. In particular, the modified shielding ring 1011 includes an outer portion and an inner portion. The outer portion is raised compared to the inner portion, which forms a step around which fluid must flow. FIG. 10D is shown very close up to highlight the relevant dimensions of the peripheral passage 1023, which in this embodiment is defined between the substrate support 902 and the outer raised portion of shielding ring 1011. Compared to the peripheral passage 923 in FIGS. 9C and 9D, the peripheral passage 1023 is much narrower, since it is formed between the substrate support 902 and the shielding ring 1011, as opposed to between the substrate support 902 and the weir wall 921. In other words, the peripheral passage 1023 has a higher dimensionless peripheral passage parameter than peripheral passage 923. In FIG. 10D, the dimensionless peripheral passage parameter is calculated as $\delta=H_4/(0.5*(W_{t4}+W_{b4})$. The remaining elements shown in FIGS. 10C and 10D are the same as those shown in FIGS. 9C and 9D, and the description will not be repeated.

In these or other embodiments where the peripheral passage 1023 is defined between the substrate support 902 and a shielding ring 1011 (or a weir wall or other piece of hardware radially outside the substrate support in the horizontal plane near the bottom of the substrate support), the peripheral passage 1023 may have a height ($H_4$) between about 0.1-1 inches, for example between about 0.1-0.7 inches. In some cases, the height of the shielding ring 1011, and therefore the height of the peripheral passage 1023 may extend all the way up to the electrolyte-air interface. In such an embodiment, the shielding ring 1011 extends up to the same height/vertical position as the weir wall 921. The peripheral passage 1023 may have an average width between about 0.02-0.5 inches, for example between about 0.06-0.22 inches. The dimensionless peripheral passage parameter may be at least about 1.6, at least about 2, at least about 3, or at least about 5 in various embodiments. In some cases the dimensionless peripheral passage parameter may be between about 1.6-10, or between about 2-10, or between about 2-5, or between about 2-3.5, for example between about 2.2-2.6. As with other specific embodiments presented herein, these dimensions and parameter values can be applied to other annular fluid pathways used with substrate holders in electroplating apparatus. In other words, the disclosed dimensions may describe any peripheral passage through which electrolyte flows after exiting the plating gap and before reaching the electrolyte-air interface.

In one particular example of the embodiment shown in FIGS. 10C and 10D, $H_4$=0.2 cm, $W_{t4}$=$W_{b4}$=0.06 cm, and $\delta$=0.2/0.06=3.33.

Though many of the embodiments herein have been presented in the context of a peripheral passage that is defined between a substrate support and some type of annular ring that sits outside the substrate support during plating (e.g., a DC clamp ring or a shielding ring/insert), the embodiments are not so limited. The disclosed dimensionless peripheral passage parameter may also describe a peripheral passage that is defined between other surfaces. Generally speaking, in order to be considered a relevant peripheral passage, electrolyte should pass through the peripheral passage after leaving the plating gap at the periphery of the substrate. Further, electrolyte should travel through the peripheral passage before being exposed to the electrolyte-air interface (although in some cases the electrolyte-air interface is located right at the top of a relevant peripheral passage, for example where a DC clamp ring or shielding ring extends all the way up to the weir wall of the electroplating cell). In the context of FIG. 2, for instance, the peripheral passage is between the wafer holder 201 and the weir walls 244. In various embodiments, the peripheral passage is at least partially defined between a first surface that rotates relative to a second surface, and the second surface. The rotating surface may be positioned radially inside of the non-rotating surface. For example, in the context of FIG. 9A, the peripheral passage is defined between the substrate support (which rotates) and the DC clamp ring 910 (which does not rotate). In the context of FIG. 2, the peripheral passage is defined as noted above, between the wafer holder (which rotates) and the weir walls 244 (which do not rotate). The peripheral passage has dimensions and an orientation that resists passage of bubbles between the fluid-air interface and the gap between the substrate and the CIRP (or other structure defining the bottom of the gap). The fluid in the peripheral passage will remain relatively unperturbed during disturbances at the fluid-air interface. Further, the peripheral passage may have one or more bends, angles, or obstructions that prevent a clear line of sight between the point at which fluid exits gap and the electrolyte-air interface.

Figure 11A:
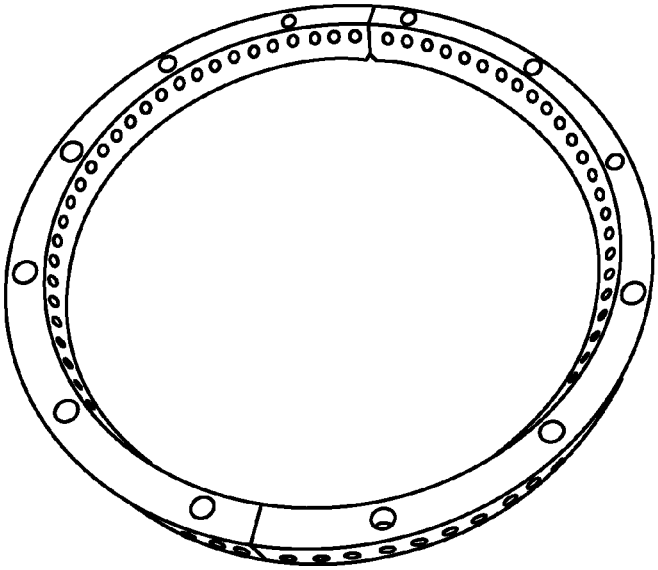
FIG. 11A depicts a modified DC clamp ring as shown in FIGS. 10A and 10B.
Figure 11B:
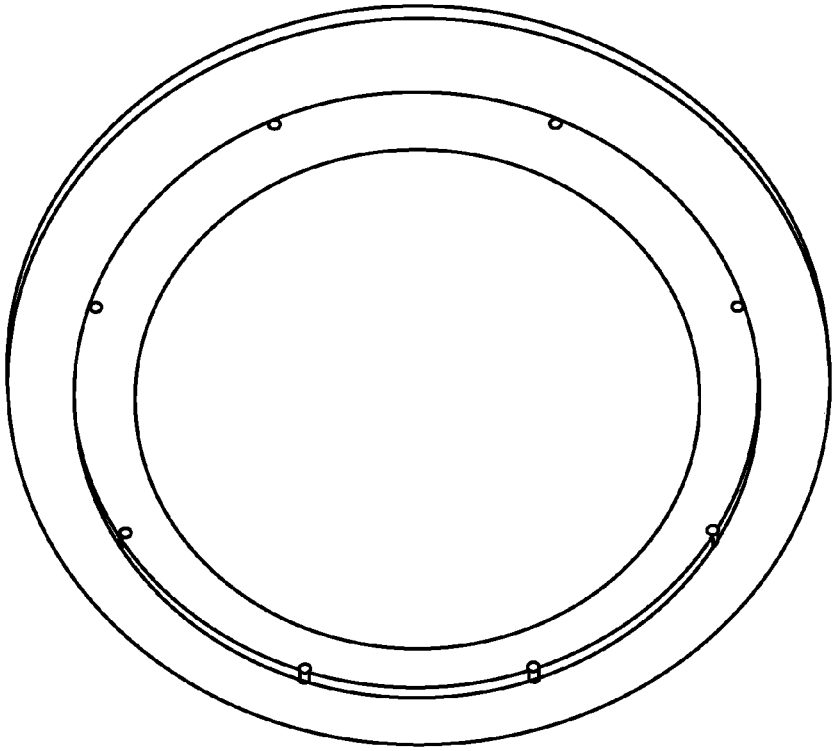
FIG. 11B depicts a modified shielding ring as shown in FIGS. 10C and 10D.
Figure 11C:
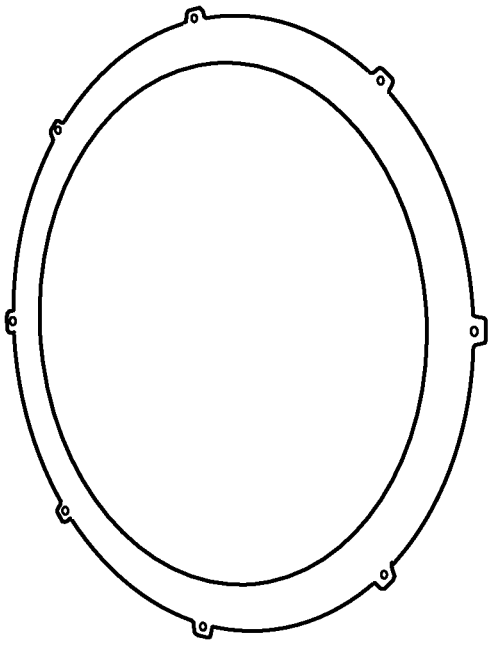
FIG. 11C shows a baseline shielding ring as shown in FIGS. 9C and 9D.

FIG. 11A shows a DC clamp ring similar to the ring 1010 shown in FIGS. 10A and 10B. The channels providing ionic communication between the catholyte and the electrolyte in the DC chamber are visible in FIG. 11A. FIG. 11B shows a shielding ring similar to the ring 1011 shown in FIGS. 10C and 10D. As shown most clearly in FIGS. 10C and 11B, the shielding ring includes an outer portion and an inner portion. The outer portion is raised compared to the inner portion. The raised outer portion creates a step around which the electrolyte flows, partially defining the relevant peripheral passage. FIG. 11C presents a baseline shielding ring frequently used with a domed CIRP, similar to the ring 911 shown in FIGS. 9C and 9D.

The shape of the peripheral passage through which electrolyte passes after exiting the plating gap near the periphery of the substrate has a substantial effect on the maximum substrate rotation rate (and the throughput). As noted above in relation to FIGS. 4-6, another factor that can have a significant effect on the maximum substrate rotation rate is the liquid replenishment rate, which is proportional to the flow rate of electrolyte passing through the plating gap divided by the height of the plating gap. The flow rate of electrolyte passing through the plating gap is also sometimes referred to as the pump rate. The use of a relatively higher electrolyte flow rate and/or a relatively smaller plating gap results in a higher liquid replenishment rate, which permits bubble-free plating at higher substrate rotation rates. In particular, the maximum plating rate ($RPM_{max}$) scales with the liquid replenishment rate (LRR) as follows: $(RPM_{max}) \propto LRR^{1/4}$.

In certain embodiments, the height of the plating gap (measured as defined above) is between about 0.2-6 mm, or between about 0.5-2 mm. The height of the plating gap may be limited by certain process and/or hardware limitations. In these or other cases, the flow rate of electrolyte through the plating gap may be between about 3-45 LPM, or between about 6-25 LPM. The flow rate of electrolyte may be limited by certain hardware limitations such as pump capacity, pipe diameter, etc. The maximum substrate rotation rate in these or other embodiments may be between about 150-450 RPM, for example between about 200-380 RPM. In some embodiments, the maximum substrate rotation rate is at least about 200, for example at least about 230. The use of relatively higher liquid replenishment rate and/or hardware having a relatively higher dimensionless peripheral passage parameter allows for the use of relatively higher maximum substrate rotation rate.

Another factor that can affect the likelihood that bubbles become entrained under the substrate is the height of the electrolyte-air interface, and more particularly, the vertical distance between the substrate (when installed in the substrate support/cup) and the electrolyte-air interface. By increasing this height/distance (e.g., by increasing the height of the weir walls where electrolyte spills over), the likelihood of air bubble entrainment is reduced. In certain embodiments, the vertical distance between the plating face of the substrate (when installed in the substrate support and in a plating position) and the electrolyte-air interface (which in many cases is controlled by the height of the weir wall) is between about 10-25 mm, for example between about 15-20 mm. In some embodiments, this distance is at least about 10 mm, for example at least about 15 mm.

Returning to the graph shown in FIG. 8, the baseline hardware included a flat CIRP with a baseline DC clamp ring as shown in FIGS. 9A and 9B, and the modified hardware included a flat CIRP with a modified DC clamp ring 1010 as shown in FIGS. 10A and 10B. By using a taller and wider DC clamp ring 1010, the resulting modified peripheral passage 1023 of FIG. 10B was taller and narrower compared to the baseline peripheral passage 923 shown in FIG. 9B. The modified peripheral passage 1023 therefore had a larger dimensionless peripheral passage parameter, δ. These modifications resulted in a substantial increase in the maximum substrate rotation rate for bubble-free plating, as shown in FIG. 8. In particular, at an electrolyte flow rate of about 15 LPM, bubble-free plating was extended from about 240 RPM in the baseline case up to about 350 RPM in the modified hardware case, an increase of about 45%. As shown in FIG. 1, this increase in plating RPM increases the limiting current of the electroplating process. At higher limiting currents, electroplating can be completed more quickly, and throughput is increased.

Additional experimental results demonstrating the benefits of the disclosed embodiments are presented in the Experimental section, below.

In a related embodiment mentioned above, electrolyte may also be provided above the CIRP, with an inlet on one side of the plating face of the substrate and an outlet on the opposite side of the plating face of the substrate. In this embodiment, the electrolyte that contacts the substrate originates from either (a) below the CIRP, or (b) the inlet on one side of the substrate. Electrolyte that originates from below the CIRP is delivered through the CIRP to impinge upon the substrate surface. Electrolyte that originates from the inlet on one side of the substrate passes over the entire surface of the substrate in a cross-flow/shearing manner before exiting primarily or exclusively at the outlet on the opposite side of the substrate. All electrolyte exits primarily or exclusively at the outlet. Where the electrolyte exits primarily (but not exclusively) at the outlet, electrolyte may exit the plating gap at other areas, though at a lower rate than through the outlet. The outlet provides less resistance to electrolyte flow compared to the other areas, for example by providing a larger gap for fluid to flow through. Where the electrolyte exits exclusively at the outlet, all the electrolyte is directed to the outlet, and none escapes through other portions around the periphery of the plating gap. In some cases the inlet and/or outlet span between about 90-180°, for example between about 90-120° around the periphery of the substrate. In certain embodiments where the electrolyte exclusively exits the plating gap at the outlet, the relevant peripheral passage is confined to the area where the outlet is located (rather than being annular and extending around the entire periphery of the substrate).

The disclosed embodiments allow substrates to be electroplated at higher rates of substrate rotation. While this is beneficial for the reasons described above, the high rotation rate can also introduce certain difficulties in some cases. In particular, where the substrate rotation rate is sufficiently high, the flow of electrolyte in the plating gap can become turbulent or partially turbulent (e.g., turbulent in the peripheral region of the substrate where the flow rate and fluid velocity are relatively greater and laminar in the central region of the substrate where the flow rate and fluid velocity are relatively lower) in some circumstances. The most relevant region to consider when determining the laminar/turbulent nature of the electrolyte flow is the area adjacent to the stagnant or diffusion region at the substrate surface. The flow through the apparatus can be modeled to predict the Reynolds number for the flow at different radial positions of the substrate (with higher Reynolds numbers expected toward the periphery of the substrate).

In some cases where a portion of the substrate experiences laminar flow and another portion of the substrate experiences turbulent flow, the quality of the plating may be poor. For instance, there may be a sharp variation in film quality between these two portions of the substrate, as evidenced by a difference in film properties such as film thickness, reflectivity, smoothness, and/or defect density. In some cases, one region of a substrate may appear smooth and reflective and another region of the substrate may show ridges or other artifacts arising from irregular copper (or other metal) growth. Without wishing to be bound by theory or mechanism of action, such differences may result from a difference in additive behavior in the laminar vs. turbulent flow regions. For example, the plating thickness may be thicker in regions that experience turbulent flow (e.g., the peripheral region of the substrate) and thinner in regions that experience laminar flow (e.g., the central region of a substrate). The thickness difference may result from the additives in the turbulent region not diffusing into recessed features at the same rate as in the laminar region. It is desirable to minimize these differences and deposit a film of uniformly high quality.

One advantage of the disclosed embodiments is the flow near the substrate is less likely to become turbulent or partially turbulent during plating at a given RPM. The presence of bubbles under the substrate can promote a more turbulent flow. As such, the absence of bubbles under the substrate helps maintain the electrolyte flow relatively more laminar than would otherwise be the case at the same RPM using hardware that is not designed to eliminate bubbles under the substrate. In some embodiments, relatively high RPM plating is used and the flow under the substrate remains laminar at all radial positions of the substrate. In other embodiments, the substrate may be rotated at a rate that achieves turbulent flow over at least a portion of the substrate. The turbulent flow is most likely to occur toward the periphery of the substrate, and may occur even in cases where the disclosed hardware is used and no bubbles are present under the substrate. In these cases, it may be beneficial to choose an additive package (e.g., accelerator, suppressor, leveler, etc.) whose behavior is relatively less dependent (or independent) of the laminar/turbulent nature of the electrolyte flow. Where the additive behavior is less dependent on the nature of the electrolyte flow, the risk of forming film with widely varying properties/quality is minimized. In this way, the problems related to having both laminar and turbulent regions on the substrate during plating can be minimized.

System Controller

The methods described herein may be performed by any suitable apparatus that is configured as described herein. A suitable apparatus typically includes hardware for accomplishing the process operations and a system controller having instructions for controlling process operations in accordance with the present invention. For example, in some embodiments, the hardware may include one or more process stations (e.g., electroplating chambers) included in a process tool.

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of electrolyte and other fluids, temperature settings (e.g., heating and/or cooling), pressure settings, vacuum settings, potential, current, and/or power settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

In various embodiments, a system controller controls some or all of the operations of a process tool. The system control software implemented on the system controller may include instructions for controlling the timing, flow rate of electrolyte, mixture of electrolyte components, inlet pressure, plating cell pressure, plating cell temperature, wafer temperature, current and potential applied to the wafer and any other electrodes, wafer position (and therefore plating gap geometry), wafer rotation, wafer immersion speed, and other parameters of a particular process performed by the process tool. System control software may be configured in any suitable way. For example, various process tool component subroutines or control objects may be written to control operation of the process tool components necessary to carry out various process tool processes. System control software may be coded in any suitable computer readable programming language.

Other computer software and/or programs may be employed in some embodiments. Examples of programs or sections of programs for this purpose include a substrate positioning program, an electrolyte composition control program, an electrolyte flow control program, a pressure control program, a heater control program, a substrate rotation control program, and a potential/current power supply control program.

In some cases, the controllers control one or more of the following functions: wafer immersion (translation, tilt, rotation), fluid transfer between tanks, etc. The wafer immersion may be controlled by, for example, directing the wafer lift assembly, wafer tilt assembly and wafer rotation assembly to move as desired. The controller may control the fluid transfer between tanks by, for example, directing certain valves to be opened or closed and certain pumps to turn on and off. The controllers may control these aspects based on sensor output (e.g., when current, current density, potential, pressure, etc. reach a certain threshold), the timing of an operation (e.g., opening valves at certain times in a process) or based on received instructions from a user.

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

Experimental

Figure 12A:
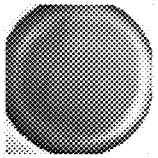
Figure 12A:
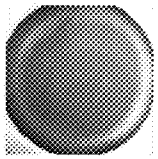
Figure 12A:
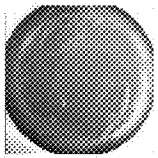
Figure 12A:
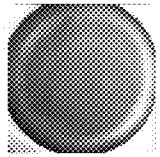
Figure 12A:
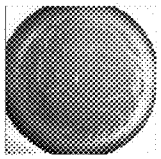
Figure 12A:
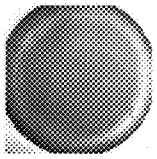
Figure 12A:
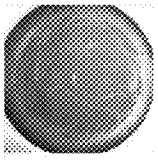
Figure 12A:
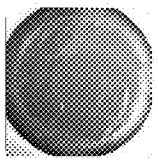

FIGS. 12A and 12B present experimental results for electroplating copper at various conditions using baseline hardware as shown in FIGS. 9A and 9B, and using modified hardware with a relatively taller/wider DC clamp ring (and therefore a taller/narrower peripheral passage) as shown in FIGS. 10A and 10B. FIG. 12A shows the wafer surfaces after electroplating and the thickness non-uniformity of the surfaces. FIG. 12B shows the reflectivity of the various films. The reported NU values refer to the thickness non-uniformity of the relevant plated substrate. EE refers to edge exclusion, which relates to the amount by which the edge of the substrate is ignored in calculating the thickness non-uniformity. For example, at 3 mm EE, the outer 3 mm of the substrate periphery is ignored when measuring the thickness non-uniformity, and at 5 mm EE, the outer 5 mm of the substrate periphery is ignored. The substrates were plated at either 15 or 25 A (plating current), either 120 or 300 RPM (maximum rate of substrate rotation during plating), either 6, 12, or 15 LPM (flow rate of electrolyte through the plating gap), and at either a 1 or 2 mm plating gap (PG, the distance between the plating face of the substrate and the upper surface of the CIRP).

Under condition 1 (15 A, 120 RPM, 6 LPM, 2 mm PG), both the baseline hardware and the modified hardware showed fairly good plating results, with no obvious signs of bubble entrainment, and relatively low non-uniformity. At higher substrate rotation rates under condition 2, (25 A, 300 RPM, 15 LPM, 1 mm PG), the baseline hardware shows significantly worse results than the modified hardware. The wafer surface shows clear signs of bubble entrainment and the non-uniformity ranges between 5.5-8.8% (depending on the degree of edge exclusion). Comparatively, where the modified hardware is used under condition 2, the wafer surface is still very smooth, and the non-uniformity is much lower than in the baseline case. Under condition 3 (25 A, 300 RPM, 15 LPM, 2 mm PG) and condition 4 (25 A, 300 RPM, 12 LPM, 2 mm PG), the baseline hardware showed clear signs of severe bubble entrainment. The quality of the plated film on the wafer surface is very bad, and the power supply experienced a voltage error due to the presence of air under the substrate, leading to failure of the electroplating process. However, where the modified hardware was used, the plating results were still very good under condition 3, with a fairly smooth wafer surface and non-uniformity ranging between about 1.7-2.3% (depending on the degree of edge exclusion). Under condition 4, the wafer surface was somewhat less smooth, with non-uniformity increasing to between about 3.2-3.8% (depending on the degree of edge exclusion). Although the modified hardware shows some signs of bubble entrainment under condition 4, the results are still much better compared to the baseline hardware under condition 4.

As shown in FIG. 12B, the reflectivity of all the films tested ranged between about 140-144%. These reflectivity results suggest that the modified hardware did not deleteriously affect the film roughness.

Figure 13:
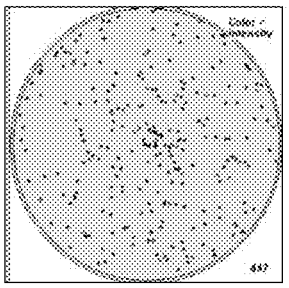
FIG. 13 depicts defect maps showing the number and location of defects on copper films plated using different recipes on the baseline and modified hardware as described herein.
Figure 13:
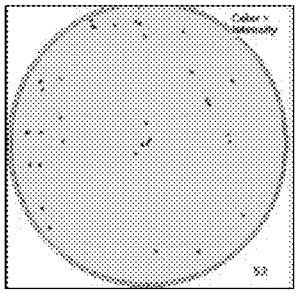
Figure 13:
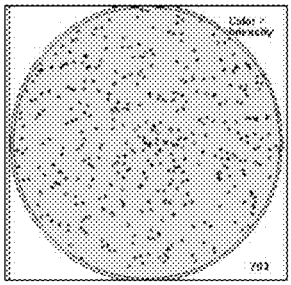
Figure 13:
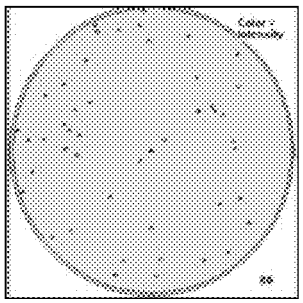

FIG. 13 presents defect maps showing the number/location of defects on substrates plated with either the baseline DC clamp ring hardware (as shown in FIGS. 9A and 9B) or with the modified DC clamp ring hardware (as shown in FIGS. 10A and 10B). Results for two different plating recipes are shown, one recipe being sensitive to formation of pits (recipe 1) and one recipe that is sensitive to formation of fine particles and protrusions (recipe 2). The modified hardware shows significantly fewer defects (53 defects compared to 447 defects for recipe 1 and 88 defects compared to 703 defects for recipe 2) than the baseline hardware, which is a substantial improvement. The substrates were 300 mm diameter substrates.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. An apparatus for electroplating metal onto a substrate, the apparatus comprising:

a substrate support for supporting the substrate at its periphery, wherein when the substrate is present in the substrate support, a plating face of the substrate is held in a substrate plating plane;

a plating gap formed below the substrate plating plane and above an opposing surface positioned under the substrate plating plane;

a pump for delivering electrolyte such that the electrolyte flows into the plating gap;

a peripheral passage positioned radially outside of the substrate support, wherein the peripheral passage has a dimensionless peripheral passage parameter of about 2 or greater, and wherein electrolyte flows through the peripheral passage after the electrolyte exits the plating gap at the periphery of the plating gap and before the electrolyte reaches an electrolyte-air interface; and a controller having instructions to control electroplating in a manner that does not result in the passage of air through the peripheral passage and under the substrate.

2. The apparatus of claim 1, wherein the peripheral passage is at least partially defined by the substrate support.

3. The apparatus of claim 1, wherein the peripheral passage is at least partially defined by a ring positioned radially outside of the substrate support.

4. The apparatus of claim 3, wherein the ring is a dual cathode clamp ring.

5. The apparatus of claim 3, wherein the ring is a shielding ring.

6. The apparatus of claim 3, wherein the ring comprises an electrically insulating material.

7. The apparatus of claim 1, wherein the peripheral passage has a dimensionless peripheral passage parameter between about 2-10.

8. The apparatus of claim 1, wherein the peripheral passage has a height of at least about 0.1 inches.

9. The apparatus of claim 1, the electrolyte-air interface having a resting position when the substrate is not being rotated, wherein a vertical distance between the substrate plating plane and the resting position of the electrolyte-air interface is at least about 10 mm.

10. The apparatus of claim 1, wherein the peripheral passage is annularly shaped.

11. The apparatus of claim 1, wherein the opposing surface positioned under the substrate plating plane is a surface of a channeled ionically resistive plate (CIRP), the CIRP comprising a plurality of through-holes, the apparatus further comprising an inlet above the CIRP for providing electrolyte to the plating gap and an outlet above the CIRP for receiving electrolyte from the plating gap, the inlet and outlet each extending between about 90-180° around the plating gap, the inlet and outlet positioned on opposite sides of the plating gap, wherein the peripheral passage is positioned proximate the outlet.

12. The apparatus of claim 11, wherein the peripheral passage is not annularly shaped.

13. The apparatus of claim 1, wherein the plating gap has a height between about 0.5-6 mm.

14. The apparatus of claim 1, wherein the electrolyte follows a flow path after exiting the plating gap and before reaching the electrolyte-air interface, the flow path having a tortuosity of at least about 1.1.

15. The apparatus of claim 1, wherein the peripheral passage is at least partially defined between a first surface that is substantially stationary during electroplating and a second surface that rotates during electroplating.

16. The apparatus of claim 1, further comprising a substrate rotation mechanism for rotating the substrate within the substrate plating plane, wherein the controller has instructions to rotate the substrate within the substrate plating plane via the substrate rotation mechanism.

17. The apparatus of claim 1, wherein the opposing surface positioned under the substrate plating plane is a surface of a channeled ionically resistive plate (CIRP), the CIRP comprising a plurality of through-holes, wherein the pump delivers electrolyte such that the electrolyte passes from below the CIRP, through the through-holes in the CIRP, and into the plating gap.

18. The apparatus of claim 17, wherein at least a portion of the through-holes are oriented at a non-normal angle with respect to the substrate plating plane.

19. A method of electroplating metal onto a substrate, the method comprising:

positioning the substrate in a substrate support;

immersing the substrate in electrolyte in an electroplating chamber;

supplying current to cause metal to electroplate onto the substrate;

flowing electrolyte into a plating gap defined between the substrate and an opposing surface positioned under the substrate such that the electrolyte impinges upon the substrate, and flowing electrolyte from a periphery of the plating gap through a peripheral passage positioned radially outside of the substrate support, wherein electrolyte flows through the peripheral passage before reaching an electrolyte-air interface, wherein the peripheral passage has a dimensionless peripheral passage parameter of at least about 2;

wherein during electroplating, air does not travel through the peripheral passage and under the substrate.

20. The method of claim 19, wherein the peripheral passage is at least partially defined by the substrate support.

21. The method of claim 19, wherein the peripheral passage is at least partially defined by a ring positioned radially outside of the substrate support.

22. The method of claim 21, wherein the ring is a dual cathode clamp ring.

23. The method of claim 21, wherein the ring is a shielding ring.

24. The method of claim 19, wherein the opposing surface positioned under the substrate is a surface of a channeled ionically resistive plate (CIRP), the CIRP comprising a plurality of through-holes, wherein electrolyte flows from below the CIRP, through the through-holes of the CIRP, and into the plating gap.

25. The method of claim 24, wherein at least a portion of the through-holes are oriented at a non-normal angle with respect to the substrate.

26. The method of claim 19, wherein the substrate is rotated during electroplating.

* * * * *